US010852662B2

(12) United States Patent
Oka et al.

(10) Patent No.: US 10,852,662 B2
(45) Date of Patent: Dec. 1, 2020

(54) DEVELOPING DEVICE, PROCESS CARTRIDGE AND IMAGE FORMING APPARATUS

(71) Applicant: CANON KABUSHIKI KAISHA, Tokyo (JP)

(72) Inventors: Takuya Oka, Yokohama (JP); Yoshihiro Mitsui, Numazu (JP); Akinobu Saito, Yokohama (JP); Shinichi Agata, Suntou-gun (JP); Kentaro Yamawaki, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/681,996

(22) Filed: Nov. 13, 2019

(65) Prior Publication Data

US 2020/0150558 A1 May 14, 2020

(30) Foreign Application Priority Data

Nov. 14, 2018 (JP) ..... 2018-213994
Aug. 27, 2019 (JP) ..... 2019-155097

(51) Int. Cl.
*G03G 15/08* (2006.01)

(52) U.S. Cl.
CPC ..... *G03G 15/0812* (2013.01); *G03G 15/08* (2013.01)

(58) Field of Classification Search
CPC ..... G03G 15/0812; G03G 2215/0866; G03G 15/08
USPC ..... 399/284
See application file for complete search history.

(56) References Cited

U.S. PATENT DOCUMENTS

| | | | | |
|---|---|---|---|---|
| 7,945,195 | B2 | 5/2011 | Inoue | |
| 8,265,529 | B2 | 9/2012 | Mori | |
| 2009/0317144 | A1 | 12/2009 | Koido | |
| 2010/0215410 | A1* | 8/2010 | Ito | G03G 15/0812 399/284 |
| 2013/0322932 | A1* | 12/2013 | Nishida | G03G 15/0812 399/284 |
| 2018/0329327 | A1* | 11/2018 | Yamawaki | G03G 9/0825 |

FOREIGN PATENT DOCUMENTS

| | | | |
|---|---|---|---|
| JP | 2008139552 | A | 6/2008 |
| JP | 2010002613 | A | 1/2010 |
| JP | 2010170021 | A | 8/2010 |

* cited by examiner

*Primary Examiner* — Robert B Beatty
(74) *Attorney, Agent, or Firm* — Rossi, Kimms & McDowell LLP

(57) ABSTRACT

A developing device includes a developer carrying member, a developing frame, and a regulating member. The regulating member includes a curved surface portion contactable to a surface of the developer carrying member, and satisfies the following relationships: 200 MPa≤HM≤1100 MPa, and 0.08 mm≤Rb≤0.3 mm, where HM is a Martens hardness of toner contained in the developer under a maximum load of $2.0\times10^{-4}$ N, and Rb is a radius of curvature of the curved surface portion.

15 Claims, 6 Drawing Sheets

DEVELOPING DEVICE, PROCESS CARTRIDGE AND IMAGE FORMING APPARATUS

FIELD OF THE INVENTION AND RELATED ART

The present invention relates to a developing device, a process cartridge and an image forming apparatus. Particularly, the present invention relates to an electrophotographic image forming apparatus and to the developing device and the process cartridge which are used in the electrophotographic image forming apparatus.

In general, the developing device includes a frame accommodating toner and a developing roller, and an amount of the toner carried on the developing roller is regulated by a developing blade.

Incidentally, there is a constitution in which in order to obtain a contact pressure (pressure per unit area) of the developing blade to the developing roller, the developing blade is formed by being bent so that one end (free end) thereof contacting the developing roller is bent in a substantially L-shape toward an opposite side from a developing roller side.

In a developing blade disclosed in Japanese Laid-Open Patent Application (JP-A) 2010-170021, a free end thereof is bent with a predetermined radius of curvature and thereafter extends so as to separate from a surface of the developing roller.

In the developing blade as in JP-A 2010-170021, in the case where the radius of curvature of the bent portion is increased, a region (area) in which the developing blade is contactable to the developing roller expands, so that the contact pressure is liable to disperse (lower). As a result, the contact pressure (particularly "peak pressure") from the developing blade to the developing roller is not readily ensured, so that the case where the toner on the developing roller is not effectively regulated exists (i.e., there is a possibility of an occurrence of "improper regulation").

On the other hand, in the case where the radius of curvature of the bent portion is decreased, an outer periphery side (contact side) of the bent portion is extended, so that the case where an uneven shape (crack) in a "bun shape" occurs on a surface (contact surface) of the developing blade on the outer periphery side. The toner is liable to be deposited on the uneven surface and the case where improper regulation due to fusion of a deposited toner occurs on the developing blade by friction of the developing blade with the developing roller also exists. Particularly, as regards the developer used conventionally, a component low in hardness is contained in some cases, and therefore, the toner is liable to be deposited on the developing blade, so that the fusion of the toner onto the developing blade is liable to becomes worse.

SUMMARY OF THE INVENTION

The present invention has been accomplished in view of the above-described problems. A principal object of the present invention is to provide a developing device, a process cartridge and an image forming apparatus which are capable of alleviating a degree of fusion of a developer on a regulating member while ensuring a contact pressure (peak pressure) of the regulating member to a developer carrying member.

According to an aspect of the present invention, there is provided a developing device comprising: a developer carrying member configured to carry a developer; a developing frame configured to rotatably support the developer carrying member; and a regulating member provided in the developing frame and configured to regulate a thickness of the developer carried on the developer carrying member by contact thereof with a surface of the developer carrying member, wherein the regulating member includes a curved surface portion contactable to the surface of the developer carrying member, and satisfies the following relationships:

200 MPa≤HM≤1100 MPa, and 0.08 mm≤Rb≤0.3 mm, where HM is a Martens hardness of toner contained in the developer under a maximum load of $2.0\times10^{-4}$ N, and Rb is a radius of curvature of the curved surface portion.

According to another aspect of the present invention, there is provided a process cartridge comprising the above-described developing device and an image bearing member configured to bear a developer image.

According to a further aspect of the present invention, there is provided an image forming apparatus comprising the above-described developing device according to claim 1, the image bearing member configured to bear the developer image, and a transfer member configured to transfer the developer image from the image bearing member onto a recording material.

DESCRIPTION OF EMBODIMENTS

Herein, "or more", "or less" and "(numerical value) to (numerical value)" which represent numerical ranges mean numerical ranges inclusive of a lower limit and an upper limit which are endpoints, unless otherwise specified.

Hereinbelow, embodiments of the present invention will be specifically described with reference to the drawings. However, dimensions, materials and shapes of constituent elements and their relative arrangements and the like described in the following embodiments should be changed appropriately depending on structures and various conditions of accommodates (devices) to which the present invention is applied. That is, the scope of the present invention is not intended to be limited to the following embodiments.

General Structure of Image Forming Apparatus

Figure 1:
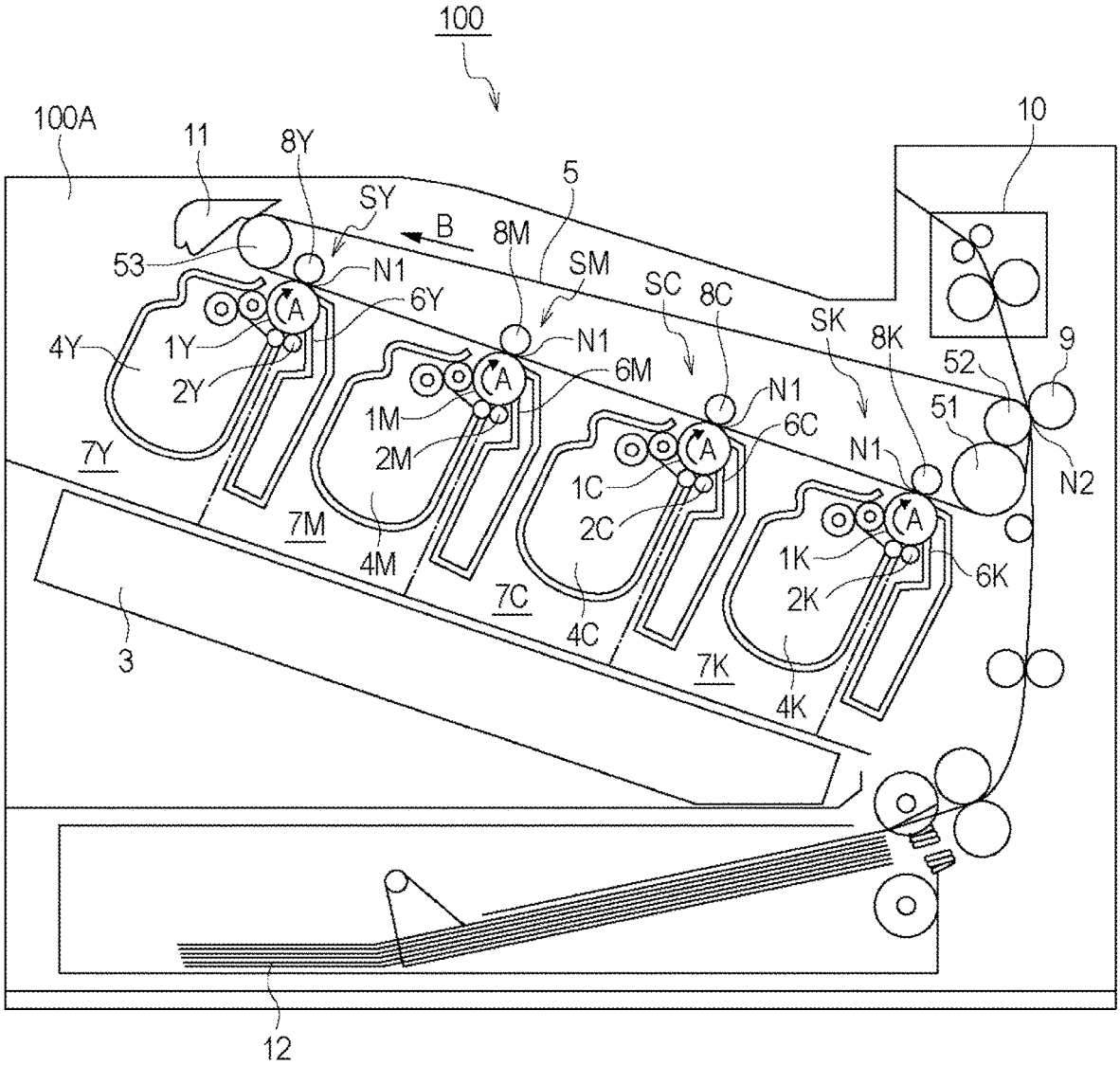
FIG. 1 is a schematic sectional view of an image forming apparatus according to an embodiment.

With reference to FIG. 1, a general structure of an electrophotographic image forming apparatus in this embodiment will be described. FIG. 1 is a schematic sectional view of an image forming apparatus 100.

As the image forming apparatus to which the present invention is applicable, it is possible to cite a copying machine, a printer, a facsimile machine and the like which utilizes an electrophotographic type, and in this embodiment, the case where the present invention is applied to a laser printer will be described. The image forming apparatus of this embodiment is a full-color laser printer employing an in-line type and an intermediary transfer type. The image forming apparatus 100 is capable of forming a full-color image, in accordance with image information, on a recording material 12 (for example, a recording sheet, a plastic sheet, a cloth or the like). The image information is inputted to an image forming apparatus main assembly 100A from an image reading device connected to the image forming apparatus main assembly 100A or from a host device such as a personal computer communicatably connected to the image forming apparatus main assembly 100A.

The image forming apparatus 100 includes, as a plurality of image forming portions, first, second, third and fourth image forming portions SY, SM, SC and SK for forming images of colors of yellow (Y), magenta (M), cyan (C) and black (K), respectively. In this embodiment, the first to fourth image forming portions SY, SM, SC and SK are arranged in line in a direction crossing the vertical direction. Incidentally, constitutions and operations of the first to fourth image forming portions are the substantially same except that the colors of the images to be formed are different from each other. Accordingly, in the case where the image forming portions are not particularly required to be distinguished from each other, suffixes Y, M, C and K added to reference numerals for representing elements for the associated colors are omitted, and the elements for the associated colors will be collectively described.

The image forming apparatus 100 includes, as a plurality of image bearing members, four drum-shaped electrophotographic photosensitive members which are juxtaposed, i.e., photosensitive drums 1. Each of the photosensitive drums 1 is rotationally driven in an arrow A direction (clockwise direction) in FIG. 1 by an unshown driving means (driving source). At a periphery of the photosensitive drum 1, a charging roller 2 as a charging means for electrically charging a surface of the photosensitive member 1 uniformly, a scanner unit 3 (exposure device) as an exposure means for forming an electrostatic (latent) image on the photosensitive drums 1 by irradiating the photosensitive drum 1 with laser light on the basis of the image information are provided. Further, at the periphery of the photosensitive drum 1, a developing unit (developing device) 4 as a developing means for developing the electrostatic image into a toner image (developer image) and a cleaning member 6 as a cleaning means for removing transfer residual toner remaining on a surface of the photosensitive member 1 after transfer are provided. Further, an intermediary transfer belt 5 as an intermediary transfer member for transferring the toner images from the photosensitive drums 1 onto a recording material 12 is provided on and opposed to the four photosensitive drums 1.

Incidentally, in this embodiment, the developing unit 4 carries out reversal development in a state in which the developing roller as a developer carrying member is contacted to the photosensitive member 1. That is, in this embodiment, the developing unit 4 develops the electrostatic image by depositing a toner, charged to the same polarity (negative in this embodiment) as a charge polarity of the photosensitive drum 1, on a portion (image portion, exposed portion) where an electric charge is attenuated by the exposure of the photosensitive drum 1 to light.

In this embodiment, the photosensitive drum 1 and as process means such as the actable on the photosensitive member 1, the charging roller 2, developing unit 4 and the cleaning member 6 are integrally assembled into a cartridge (unit) to form a process cartridge 7. The process cartridge 7 is detachably mountable to the image forming apparatus 100 through mounting means such as a mounting guide and a positioning member which are provided in the image forming apparatus main assembly 100A. In this embodiment, process cartridges 7 for the respective colors have the same shape and accommodate toners of the colors of yellow (Y), magenta (M), cyan (C) and black (K).

The intermediary transfer belt 5 formed of an endless belt as the intermediary transfer member contacts all the photosensitive drums 1, and circulates and moves (rotates) in an arrow B direction (counterclockwise direction) in FIG. 1. The intermediary transfer belt 5 is stretched around a driving roller 51, a secondary transfer opposite roller 52 and a follower roller 53, which are used as a plurality of supporting members.

In an inner peripheral surface side of the intermediary transfer belt 5, as primary transfer means, four primary transfer rollers 8 are juxtaposed so as to oppose the photosensitive drums 1. Each of the primary transfer rollers 8 presses the intermediary transfer belt 5 toward the photosensitive drum 1 to form a primary transfer portion N1 where the intermediary transfer belt 5 and the photosensitive drum 1 contact each other. Then, to the primary transfer roller 8, from an unshown primary transfer bias voltage source (high voltage source) as a primary transfer bias applying means, a bias of an opposite polarity to a normal charge polarity of the toner is applied. As a result, the toner image is transferred (primary-transferred) from the photosensitive member 1 onto the intermediary transfer belt 5.

Further, in an outer peripheral surface side of the intermediary transfer belt 5, a secondary transfer roller 9 as a secondary transfer means is provided at a position opposing the secondary transfer opposite roller 52. The secondary transfer roller 9 press-contacts the intermediary transfer belt 5 toward the secondary transfer opposite roller 52 to form a secondary transfer portion N2 where the intermediary transfer belt 5 and the secondary transfer roller 9 contact each other. Then, to the secondary transfer roller 9, from an unshown secondary transfer bias voltage source (high voltage source) as a secondary transfer bias applying means, a bias of an opposite polarity to the normal charge polarity of the toner is applied. As a result, the toner images are transferred (secondary-transferred) from the intermediary transfer belt 5 onto the recording material 12.

Further, during image formation, first, the surface of the photosensitive drum 1 is electrically charged uniformly by the charging roller 2. Then the surface of the charged photosensitive drum 1 is subjected to scanning-exposure to laser light, depending on the image information, emitted from the scanner unit 3, so that the electrostatic image is formed on the photosensitive drum 1 correspondingly to the image information. Then, the electrostatic image formed on the photosensitive drum 1 is developed into the toner image by the developing device 4. The toner image formed on the photosensitive drum 1 is transferred (primary-transferred) onto the intermediary transfer belt 5 by the action of the primary transfer roller 8.

For example, during full-color image formation, the above-described process until the primary transfer is successively performed at the image forming portions SY, SM, SC and SK, and then the toner images of the respective colors are primary-transferred superposedly onto the intermediary transfer belt 5. Thereafter, in synchronism with movement of the intermediary transfer belt 5, the recording material 12 is fed to the secondary transfer portion N2. Then, by the action of the secondary transfer roller 9 contacting the recording material 12 toward the intermediary transfer belt 5, the four color toner images on the intermediary transfer belt 5 are secondary-transferred collectively from the intermediary transfer belt 5 onto the recording material 12. The recording material 12 on which the toner images are transferred is fed to a fixing device 10 as a fixing means. In the fixing device 10, the recording material 12 is heated and pressed, so that the toner images are fixed on the recording material 12. The recording material 12 on which the toner images are fixed is conveyed from the fixing device 10 toward a further downstream side and then is discharged to an outside of the image forming apparatus.

Primary transfer residual toner remaining on the photosensitive member 1 after the primary transfer step is removed and collected by the cleaning member 6. Further, secondary transfer residual toner remaining on the intermediary transfer belt 5 after the secondary transfer step is removed by an intermediary transfer belt cleaning device 11. Incidentally, the image forming apparatus 100 is also capable of forming a single color (monochromatic) or multicolor image by using only a desired one image forming portion or only some (not the all) of the image forming portions.

General Structure of Process Cartridge

Figure 2:
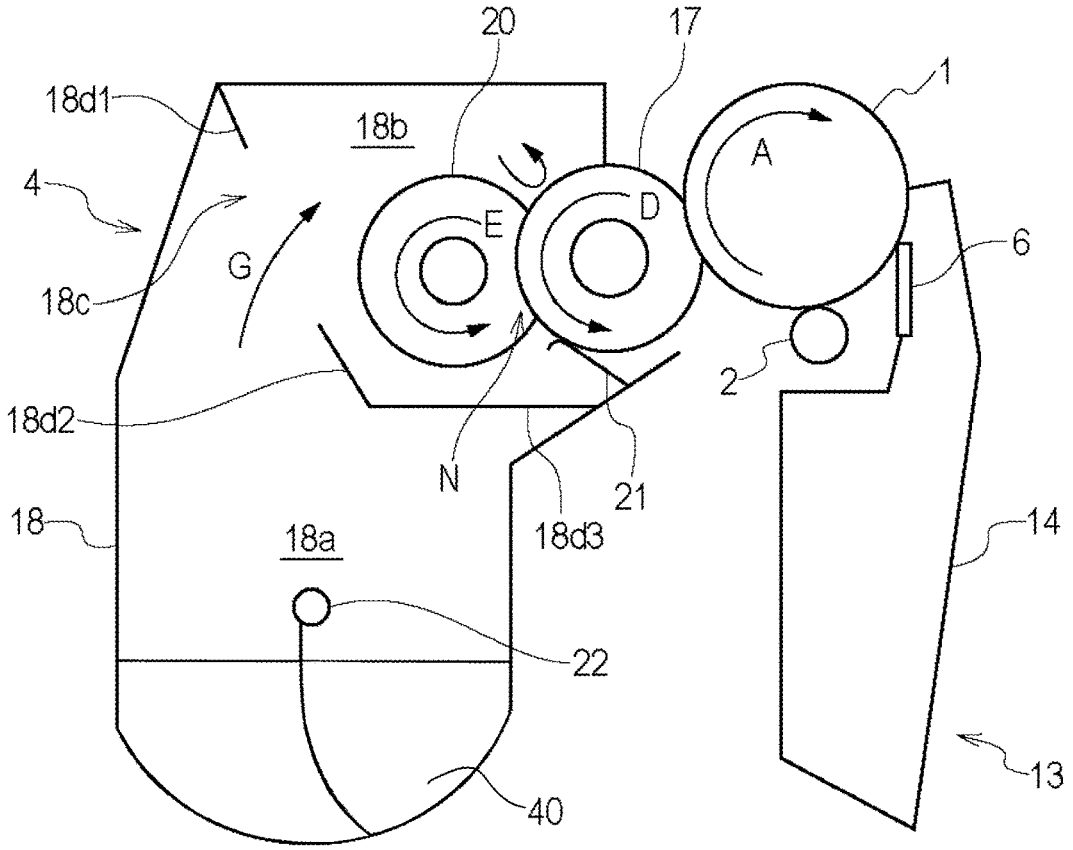
FIG. 2 is a schematic sectional view of a process cartridge according to the embodiment.

With reference to FIG. 2, a general structure of the process cartridge 7 to be mounted in the image forming apparatus 100 will be described.

In this embodiment, the structures and the operations of the process cartridges 7 for the respective colors are the substantially same except that the colors (kinds) of the toners accommodated are different from each other. FIG. 2 is a schematic sectional view (principal sectional view) of the process cartridge 7 in this embodiment as seen in a longitudinal direction (rotational axis direction) of the photosensitive member 1. An attitude of the process cartridge 7 in FIG. 2 is an attitude in a state in which the process cartridge 7 is mounted in the image forming apparatus main assembly, and in the following, in the case where positional relationships and directions and the like of respective members of the process cartridge 7 are described, the positional relationships and directions and the like are those in this attitude of the process cartridge 7. That is, an up-down direction on the drawing sheet of FIG. 2 corresponds to the vertical direction, and a left-right direction on the drawing sheet corresponds to the horizontal direction. Incidentally, setting of this arrangement is based on the premise that the image forming apparatus is installed on a horizontal surface as a normal installation state.

The process cartridge 7 has a structure in which a photosensitive member unit 13 including the photosensitive drum 1 and the like and the developing unit 4 including a developing roller 17 and the like are integrally assembled into a cartridge. The photosensitive member unit 13 includes a cleaning (member) frame 14 as a frame for supporting various elements (components) in the photosensitive member unit 13. In the (cleaning) frame 14, the photosensitive drum 1 is rotatably mounted through unshown bearings. The photosensitive member 1 is rotationally driven in an arrow A direction (clockwise direction) in FIG. 2 depending on an image forming operation by transmission of a driving force, to the photosensitive member unit, of an unshown driving motor as a driving means (driving source). In this embodiment, as the photosensitive member 1 which is principal member of the image forming process, an organic photosensitive member 1 prepared by successively coating an undercoat layer, a carrier generating layer and a carrier transporting layer which are functional films, on an outer peripheral surface of a cylinder made of aluminum.

Further, in the photosensitive member unit 14, the cleaning member 6 and the charging roller 2 are disposed so as to contact the peripheral surface of the photosensitive member 1. The transfer residual toner removed from the surface of the photosensitive member 1 by the cleaning member 6 falls in the cleaning frame 14 and is accommodated in the cleaning frame 14. The charging roller 2 as the charging means is rotated by the photosensitive member 1 at a roller portion of an electroconductive rubber thereof in press-contact with the photosensitive member 1. To a core metal of the charging roller 2, as a charging step, a predetermined DC voltage is applied toward the photosensitive member 1, so that a uniform dark-portion potential (Vd) is formed on the surface of the photosensitive member 1. The surface of the photosensitive member 1 is exposed in a spot pattern to laser light emitted from the above-described scanner unit 3 correspondingly to image data, so that an exposed portion, surface electric charges disappear by carriers from the carrier generating layer, so that a potential lowers. As a result, an electrostatic latent image with a predetermined light-portion potential (Vl) at an exposed portion and the predetermined dark-portion potential (Vd) at a non-exposed portion is formed on the photosensitive member 1. In this embodiment, Vd is −500 V, and Vl is −100 V.

Developing Unit

The developing unit 4 includes a developing roller 17, a developing blade 21, a toner supplying roller 20 and a stirring and feeding member 22. As a developer carrying member, the developing roller 17 carries toner 40. As a regulating member, the developing blade 21 regulates (a layer thickness of) the toner 40 carried on the developing roller 17. As a developer supplying member, the toner supplying roller 20 supplies the toner 40 to the developing roller 17. As a feeding member, the stirring and feeding member 22 feeds the toner to the toner supplying roller 20. The developing unit 4 includes a developing container as a frame with which each of the developing roller 17, the toner supplying roller 20 and the stirring and feeding member 22 is rotatably assembled. The developing container 18 includes a toner accommodating chamber 18*a* in which the stirring and feeding member 22 is disposed, a developing chamber 18*b* in which the developing roller 17 and the toner supplying roller 20 are disposed, and a communication opening 18*c* establishing communication between the toner accommodating chamber 18*a* and the developing chamber 18*b* so as to permit movement of the toner 40 between the toner accommodating chamber 18*a* and the developing chamber 18*b*. The communication opening 18*c* is provided at a partition wall portion 18*d* (18*d*1 to 18*d*3) for partitioning an inside of the developing container 18 into the toner accommodating chamber 18*a* and the developing chamber 18*b*.

The partition wall portion 18*d* divides an inside space of the developing frame (developing container) 18 into the toner accommodating chamber 18*a* and the developing chamber 18*b*. The partition wall portion 18*d* includes a first wall portion 18*d*1 for partitioning the inside space of the developing frame 18 at a position above the communication opening 18*c*, a second wall portion 18*d*2 for partitioning the inside space at a position below the communication opening 18*c*, and a surface wall portion 18*d*3 which is continuous to the second wall portion 18*d*2 and which partitions the inside space at a position below the toner supplying roller 20 and the developing roller 17. The first wall portion 18*d*1 and the second wall portion 18*d*2 extend in a direction inclined relative to the vertical direction so that an opening direction of the communication opening 18*c* from the toner accommodating chamber 18*a* toward the developing chamber 18*b* points upward than the horizontal direction points. The communication opening 18*c* opens so as to oppose a space above the toner supplying roller 20 in the developing chamber 18*b*, in a region on an opposite side from the developing roller 17 with respect to the toner supplying roller 20 in the partition wall portion 18*d*. As a result, not only the inside space of the developing chamber 18*b* extends in the horizontal direction toward above the toner supplying roller 20 but also the toner 40 scooped up by the stirring and feeding member 22 from below toward above the toner accommodating chamber 18*a* is readily received by the developing chamber 18*b* through the communication opening 18*c*. The third wall portion 18*d*3 extends from a lower end of the second wall portion 18*d*2 toward below the toner supplying roller 20 and the developing roller substantially in the horizontal direction. In cooperation with the second wall portion 18*d*2, the third wall portion 18*d*3 forms a structure (toner 40 storing tank) such that of the toner 40 passed through the communication opening 18*c*, the toner 40 falling from the toner supplying roller 20 and the developing roller 17 is received. This structure consisting of the second wall portion 18*d*2 and the third wall portion 18*d*3 is formed from one side surface toward the other side surface of the developing frame 18 with respect to a longitudinal direction (direction along a rotational axis of the developing roller 17 or the toner supplying roller 20).

Figure 7:
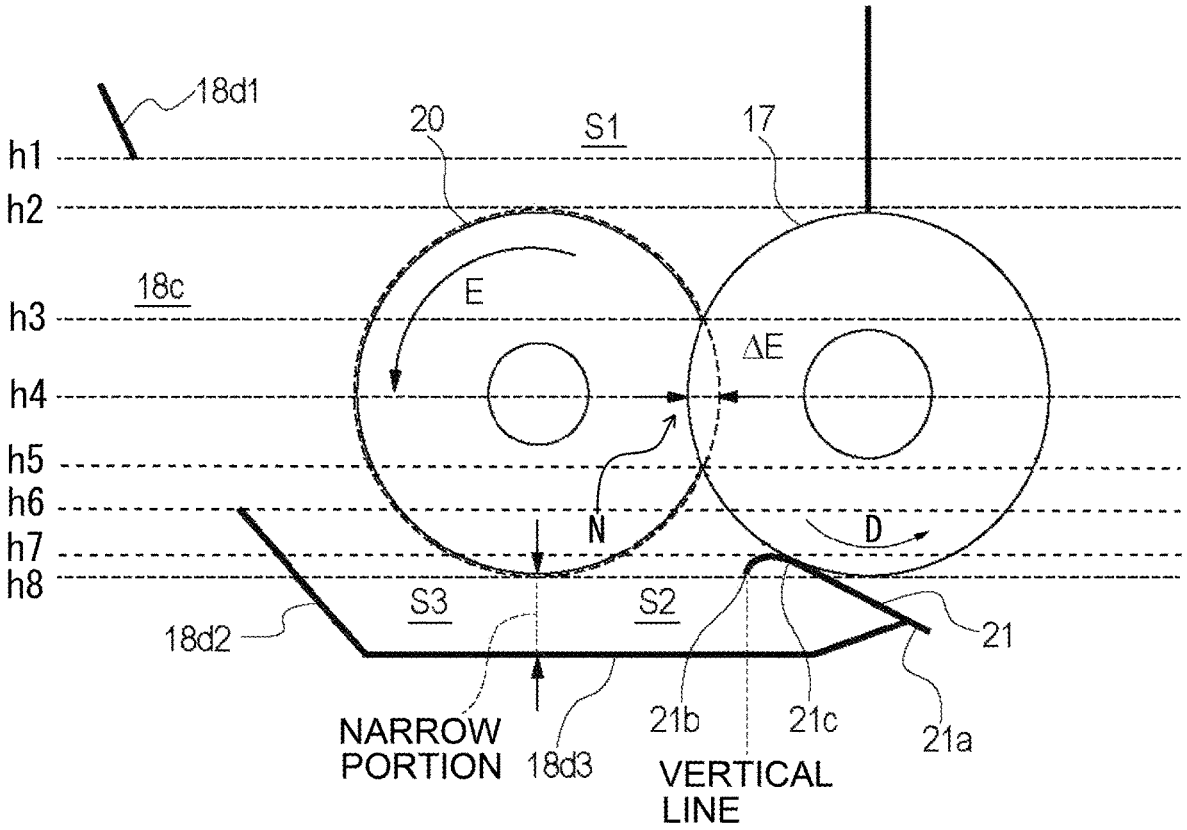
FIG. 7 is an illustration of an arrangement of the process cartridge according to the embodiment.

Here, the inside space of the developing chamber 18*b* will be considered by dividing the inside space into a first space, a second space and a third space. In FIG. 7, the first space, the second space and the third space are represented by S1, S2 and S3, respectively.

The first space refers to a space above a nip N in the developing chamber 18*b*. Specifically, the first space is a region of space in which of the inside space, a peripheral surface of the toner supplying roller 20 and the developing roller 17 and an inner wall surface of the developing chamber 18*b* oppose each other at a portion above the nip N. The first space is enclosed by a region above the nip N of the peripheral surface of the toner supplying roller 20 and the developing roller 17, and by the inner wall surface of the developing chamber 18*b* opposing these rollers and both side surfaces of the developing chamber 18*b* with respect to the longitudinal direction.

The second space refers to a space provided so as to be expanded in a downstream direction of rotation of the toner supplying roller 20 with a narrow portion, as a boundary, below the toner supplying roller 20, in the process cartridge 18*b*.

Here, the arrow portion refers to a portion where an interval between the third wall portion 18*d*3 and the toner supplying roller 20 is narrowest in an opposing region between the peripheral surface of the toner supplying roller 20 and the third wall portion 18*d*3 of the wall portion 18*d* defining the inside space of the developing chamber 18*b*.

Specifically, the second space is a region of space in which the interval between the peripheral surface of the toner supplying roller 20 and the third wall portion 18*d*3 gradually enlarges toward the downstream side of the rotational direction of the toner supplying roller 20 with the narrow portion as the boundary in the opposing space between the peripheral surface of the toner supplying roller and the third wall portion 18*d*3. The second space is enclosed by the third wall portion 18*d*3, a region of the peripheral surface of the toner supplying roller 20 and the developing roller 17 which oppose the third wall portion 18*d*3, and by the developing blade 21 and the both side surfaces of the developing chamber 18*b* with respect to the longitudinal direction, on a side downstream of the narrow portion with respect to the rotational direction of the toner supplying roller 20.

The third space refers to a space provided so as to be expanded in an upstream direction of rotation of the toner supplying roller 20 with the narrow portion, as a boundary, in the process cartridge 18*b*.

Specifically, the third space is a region of space in which the interval between the peripheral surface of the toner supplying roller 20 and the third wall portion 18*d*3 gradually enlarges toward the upstream side of the above-described rotational direction with the narrow portion as the boundary in the opposing space between the peripheral surface of the toner supplying roller and the third wall portion 18*d*3. The third space is enclosed by the second wall portion 18*d*2, the third wall portion 18*d*3, a region of the peripheral surface of the toner supplying roller 20 opposing the third wall portion 18*d*3, and by the both side surfaces of the developing chamber 18*b* with respect to the longitudinal direction, on a side upstream of the narrow portion with respect to the rotational direction of the toner supplying roller 20.

In this embodiment, in cross sections shown in FIGS. 2 and 7 and the like, the second space is configured so as to be broader than the third space.

The toner 40 scooped up by the stirring and feeding member 22 is supplied to above (first space) the nip N by getting over the toner supplying roller 20 since an upper end (boundary with a lower end of the first wall portion 18*d*1) of the communication opening 18*c* is positioned above an upper end of the toner supplying roller 20. The toner 40 supplied to above (first space) the nip N is absorbed inside (in air bubbles of a foam layer) the toner supplying roller 20 by deformation of the toner supplying roller 20 and is moved in the counterclockwise direction in FIG. 2 by rotation of the toner supplying roller 20, and then reaches a lower end of the nip N. Further, a part of the toner 40 scooped up by the stirring and feeding member 22 and supplied to the surface of the toner supplying roller 20 is returned to the toner accommodating chamber 18*a* by the rotation of the toner supplying roller 20 in an arrow E direction. The remaining toner 40 is conveyed toward a region below the toner supplying roller 20 (from the third space to the second space).

At a position where the toner 40 reaches the nip N, the toner 40 is discharged from the inside (in the air bubbles of the foam layer) of the toner supplying roller 20 by deformation of the toner supplying roller 20, and is supplied to the developing roller 17 while being slid on the developing roller 17 in the nip N. The toner 40 deposited on the developing roller 17 is regulated and electrically charged by the developing blade 21, and uniform toner coating is formed on the developing roller 17 by the toner 40 which passed through a regulating portion. Further, the toner 40 which remains on the developing roller without being used for development is also scraped off strongly by rotations of the toner supplying roller 20 and the developing roller 17 in the opposite directions at the nip N. The toner 40 detached from the developing roller 17 by being regulated by the developing blade 21 falls below (in the second space) the developing blade 21. Further, the toner 40 which is discharged from the inside of the toner supplying roller 20 and which is not deposited on the developing roller 17 is discharged to below (the second space) the nip N.

When the above-described operation is repeated, the toner 40 is gradually accumulated in the second space, so that a compaction state of the toner 40 is formed. When the compaction state is formed, the toner 40 is supplied from a compaction portion to the surface or the inside of the toner supplying roller 20. Further, by the formation of the compaction state, the toner 40 passes through the narrow portion and moves from the second space (compaction space) to the third space. By pressure of a flow of the toner 40, a part of the toner 40 gets over an upper end of the second wall portion 18*d*2 under the communication opening 18*c* and is returned to the toner accommodating chamber 18*a*.

With reference to FIG. 7, details of an arrangement of respective members in the developing chamber 18*b* in this embodiment will be described. FIG. 7 is a schematic sectional view for illustrating an arrangement (relationship) of the respective members in the developing device according to this embodiment.

(i) The upper end (boundary between the first wall portion 18*d*1 and the communication opening 18*c*) of the communication opening 18*c* separating the developing chamber 18*b* and the toner accommodating chamber 18*a* was disposed above the upper end of the developing roller 17. That is, as shown in FIG. 7, a horizontal line h1 passing through the upper end of the communication opening 18*c* is positioned above a horizontal line h2 passing through the upper end of the toner supplying roller 20.

(ii) A center (center portion with respect to a height direction or position crossing a line connecting rotation centers of the toner supplying roller 20 and the developing roller 17) of the nip N was disposed above the lower end of the communication opening, and the lower end of the nip N was disposed above the lower end of the communication opening 18*c*. that is, as shown in FIG. 7, a horizontal line h4 passing through the center of the nip N is positioned above a horizontal line h6 passing through the lower end of the communication opening 18*c* (upper end of the second wall portion 18*d*2 (boundary between the second wall portion 18*d*2 and the communication opening 18*c*)). Further, a horizontal line h5 passing through a lower end of the nip N is positioned above the horizontal line h6 passing through the lower end of the communication opening 18*c*.

(iii) The lower end (upper end of the second wall portion 18*d*2) of the communication opening 18*c* was disposed above an end portion 21*b* of the developing blade 21 on an upstream side with respect to the rotational direction of the developing roller 17 at a contact position 21*c* of the developing blade 21 with the developing roller 17. That is, as shown in FIG. 7, a horizontal line h6 passing through the lower end (upper end of the second wall portion 18*d*2) of the communication opening 18*c* is positioned above a horizontal line h7 passing through the contact portion 21*c* of the developing blade 21 with the developing roller 17.

(iv) Of an inner surface of the developing chamber 18*b* forming the second space and the third space, an upper surface of the third wall portion 18*d*3 was disposed in the following manner. First, a vertical line is drawn from the end portion 21*b* (free end) positioned, with respect to the rotational direction of the developing roller 17, upstream of the contact position 21*c* of the developing blade 21 with the developing roller 17 (FIG. 7). Then, a position of a point of intersection between the vertical line and the inner surface (upper surface of the third wall portion 18*d*3) of the developing chamber 18*b* facing the second space is taken as a reference point, and the upper surface of the third wall portion 18*d*3 was disposed so as to be a surface substantially horizontally extending from a position, horizontally distant from the reference point on a side opposite from the narrow portion, toward the third space side sandwiching the narrow portion between itself and the second space.

(v) The lower end of the communication opening 18*c* was disposed above the lower end of the toner supplying roller 20. That is, as shown in FIG. 7, the horizontal line h6 passing through the lower end (upper end of the second wall portion 18*d*2) of the communication opening 18*c* is positioned above a horizontal line h8 passing through the lower end of the toner supplying roller 20.

In the following, functional effects of the above-described arrangements (i) to (v) will be described.

(i) Positional relationship between upper end of communication opening 18*c* and upper end of toner supplying roller 20

As described above, principal toner supply to the toner supplying roller 20 is carried out by scooping up the toner 40 by the stirring and feeding member 22 and then by directly supplying the toner 40 to above (first space) the nip N. In this embodiment, the upper end of the communication opening 18*c* is disposed above the upper end of the toner supplying roller 20, and therefore, it is possible to supply the toner 40 to an inlet opening of the toner supplying roller 20 at a position above (first space) the nip N by getting over the toner supplying roller 20. The toner supplying roller 20 absorbs the toner 40 above the nip N since the toner supplying roller 20 rotates in a direction counter to the developing roller 17 in the nip N. In the case where the upper end of the communication opening 18*c* is disposed below the upper end of the toner supplying roller 20, the upper end of the communication opening 18*c* blocks a toner supply passage, and therefore, it becomes difficult to directly supply the toner to the step above the nip N. Further, in such a case, the toner supplied to a side surface of the toner supplying roller 20 is returned in a direction of the toner accommodating chamber 18*c* by the rotation of the toner supplying roller 20, so that sufficient toner supply to the toner supplying roller 20 cannot be carried out in some instances.

(ii) Positional relationship between center (central portion with respect to height direction) and lower end of communication opening 18*c*

In the case where the lower end of the communication opening 18*c* is disposed above a center position (central portion with respect to a height direction) of the nip N, a height of a surface of the toner accommodated in the second space and the third space of the developing chamber 18*b* exceeds the center position of the nip N. In such an arrangement, the toner 40 is liable to enter the nip N, and a mechanical scraping-off force of the toner supplying roller 20 to the toner 40 remaining on the developing roller 17 after a developing operation becomes weak, so that an image defect, such as "development stripe", due to insufficient scraping-off was liable to occur. For that reason, there is a need to provide a position of the lower end of the communication opening 18*c* below at least the upper end of the nip N. That is, as shown in FIG. 7, a constitution in which the horizontal line h6 passing through the lower end of the communication opening 18*c* is positioned below the horizontal line h3 passing through the upper end of the nip N is employed. Further, by disposing the lower end of the communication opening 18*c* at the position below the center position of the nip N, the scraping-off performance of the toner supplying roller 20 can be improved, and therefore, this arrangement is desirable. Further, the scraping-off performance of the toner supplying roller 20 can be further improved by disposing the lower end of the communication opening 18*c* at the position below the lower end of the nip N, and therefore, this arrangement is more desirable. That is, as shown in FIG. 7, it is desirable that the horizontal line h6 passing through the lower end of the communication opening 18*c* is positioned below the horizontal line h5 passing through the lower end of the nip N.

(iii) Positional relationship between lower end of communication opening 18*c* and free end portion of developing blade 21

The lower end of the communication opening 18*c* is disposed at the same position as or above the end portion 21*b* of the developing blade 21 positioned upstream, with respect to the rotational direction of the developing roller 17, of the contact position 21*c* between the developing blade 21 and the developing roller 17. As a result, excessive toner 40 regulated by the developing blade 21 is continuously supplied to the second space. As a result, a degree of compaction of the toner 40 in the second space is further enhanced, so that it is possible to realize toner supply from the second space to the toner supplying roller 20 and a flow of the toner 40 from the third space such that the toner 40 gets over a lower end wall of the communication opening 18*c* and is returned to the toner accommodating chamber 18*a*. In the case where the lower end of the communication opening 18*c* is disposed below the end portion 21*b* positioned upstream, with respect to the rotational direction of the developing roller 17, of the contact position 21*c* of the developing blade 21 with the developing roller 17 while satisfying other constituent requirements in this embodiment, the degree of compaction was not readily enhanced.

(iv) Positional relationship between free end portion of developing blade 21 and angle of inner wall of developing container Further, in order to move the toner 40 from the second space to the third space, there is a need to properly set an angle of a wall portion inner surface (upper surface of the third wall portion 18*d*3) of the developing frame facing the second space and the third space so as not to prevent the movement of the toner 40. Therefore, in this embodiment, a constitution in which the inner surface of the wall portion of the developing frame 18 is substantially horizontal from a position distant from the narrow portion than the point of intersection of the above-described vertical line (FIG. 7) and the inner surface (upper surface of the third wall portion 18*d*3) of the developing frame than the point of intersection is was employed. As a result, the toner 40 falling in the second space after being supplied from the toner supplying roller 20 to the developing roller 17 and then being regulated by the developing blade 21 is easily moved toward the third space sandwiching the narrow portion between itself and the second space.

Incidentally, in order to facilitate movement of the toner from the second space to the third space, a constitution in which the toner falls downwardly from the second space toward the third space may also be employed. As a result, circulation of the toner from the second space to the third space can be promoted.

(v) Positional relationship between lower end of communication opening 18*c* and toner supplying roller 20

Further, in the constitution of this embodiment, the lower end of the communication opening 18*c* was disposed above the lower end of the toner supplying roller 20. As a result, an amount of the toner returned from the third space to the toner accommodating chamber 18*a* can be controlled to a proper amount, so that it is possible to form a proper compaction space in the second space.

The developing chamber 18*b* is provided with a developing opening as an opening for delivering the toner 40 to an outside of the developing container 18, and the developing roller 17 is rotatably assembled with the developing container 18 in an arrangement such that the developing roller 17 blocks the developing opening. That is, the toner 40 accommodated in the developing container 18 is carried and conveyed by the rotating developing roller 17, and passes through the developing opening and moves to the outside of the developing container 18, so that the toner 40 is subjected to development of the electrostatic latent image on the photosensitive member 1. At that time, the amount of the toner delivered to the outside of the developing container is regulated and adjusted by the developing blade 21. The toner accommodating chamber 18*a* is positioned below the developing chamber 18*b* with respect to the to direction of gravitation. A position of the developing blade 21 with the developing roller 17 is below the rotation center of the developing roller 17 and is between the rotation centers of the developing roller 17 and the toner supplying roller 20 with respect to the horizontal direction.

The toner supplying roller 20 rotates in a direction in which the surface thereof moves from the lower end toward the upper end of the nip N, and the developing roller 17 rotates in the direction in which the surface thereof moves from the upper end toward the lower end of the nip N. That is, the toner supplying roller 20 rotates in an arrow E direction (counterclockwise direction) in FIG. 2, and the developing roller 17 rotates in an arrow D direction (counterclockwise direction) in FIG. 2. The toner supplying roller 20 and the developing roller 17 contact each other with a predetermined penetration amount.

The toner supplying roller 20 and the developing roller 17 rotate in the same direction with a peripheral speed difference, and by this operation, the toner supply to the developing roller 17 by the toner supplying roller 20 is performed. At that time, it is possible to adjust an amount of the toner supply to the developing roller 17 by adjusting a potential difference between the toner supplying roller 20 and the developing roller 17.

In this embodiment, the toner supplying roller 20 is rotationally driven at a rotational speed of 700 rpm, and the developing roller 17 is rotationally driven at a rotational speed of 700 rpm. To the toner supplying roller 20, a voltage V=−400 V is applied so that a potential difference of the toner supplying roller 20 relative to the developing roller 17 is Δ−100 V. As a result, a state in which the toner is electrically supplied easily from the toner supplying roller 20 to the developing roller 17 is formed. In this embodiment, both the developing roller 17 and the toner supplying roller 20 are 15 mm in outer diameter, and the penetration amount of the toner supplying roller 20 into the developing roller 17, i.e., a recessed amount in which the toner supplying roller 20 is depressed by the developing roller 17 was set at 1.0 mm.

The stirring and feeding member 22 not only stirs the toner 40 accommodated in the toner accommodating chamber 18*a* but also feeds the toner 40 in an arrow G direction in FIG. 2 toward above the toner supplying roller 20 in the process cartridge 18*b*. In this embodiment, the stirring and feeding member 22 is rotationally driven at a rotational speed of 130 rpm. The developing roller 17 and the photosensitive member 1 are rotated so that surfaces thereof move in the same direction (direction from below toward above in this embodiment) at an opposing portion thereof. In this embodiment, the developing roller 17 is disposed in contact with the photosensitive member 1, but a constitution in which the developing roller 17 is disposed close to the photosensitive member 1 with a predetermined interval (gap) may also be employed.

In this embodiment, as the developing roller 17, a roller coated with an elastic rubber layer (elastic layer 1702) was used. The elastic rubber layer may suitably have an MD1 hardness of 20-50 [°] in order to uniformly keep a contact state thereof with the photosensitive member 1. When the hardness is less than 20°, the surface of the developing roller 17 is not readily abraded, so that it becomes difficult to obtain a desired roller surface shape. When the hardness is larger than 50°, a contact force of the developing roller 17 to the photosensitive member 1 increases, so that the toner is liable to be deformed by press-contact the press-contact to the developing roller 17. In this embodiment, the elastic rubber layer having a rubber hardness of 38° was used. The rubber hardness was measured using a hardness meter ("HD-1 (indenter: Type A)", manufactured by Koubunshi Keiki Co., Ltd.).

The surface roughness is set at 0.2-2 [μm] in terms of a center line average roughness Ra, so that the toner in a necessary amount is held at the surface of the developing roller 17. When Ra is less than 0.2 [μm], a desired toner cannot be obtained, so that a density decreases. When Ra is larger than 2 [μm], a sufficient charge amount is not readily imparted to individual toner particles, so that the toner is deposited on a non-image portion, i.e., a so-called "fog" is liable to occur. In this embodiment, the developing roller 17 having Ra =1.0 μm was used. The center-line average roughness Ra was measured by a measuring device ("Surfcorder SE3500", manufactured by Kosaka Laboratory Ltd.).

In this embodiment, by a predetermined DC bias applied to the developing roller 17, the toner 40 is negatively charged through triboelectric charge is transferred onto only a light-portion potential portion by a potential difference thereof at a developing portion of the developing roller 17 contacting the photosensitive member 1, so that the electrostatic latent image is visualized with the toner 40. In this embodiment, the voltage V=−300 V is applied to the developing roller 17, and a potential difference ΔV=200 V with the light-portion potential portion is formed, so that the toner image is formed.

Figure 3:
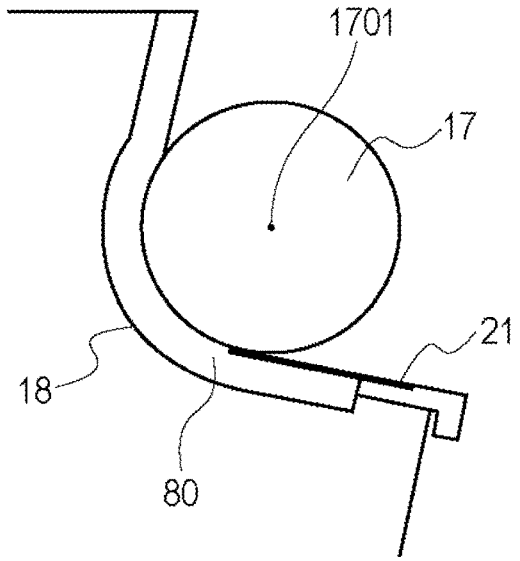
FIG. 3 is a schematic sectional view of a neighborhood of an end portion of a developing roller in the embodiment.

Referring to FIG. 3, a toner seal structure of the developing unit 4 in this embodiment will be described. FIG. 3 is a schematic sectional view showing a structure of the developing unit 4 at a periphery of an end portion of the developing roller 17 with respect to a rotational axis direction (longitudinal direction). In the developing unit 4, in a gap between the developing container 18 and a back surface of the developing blade 21 and a gap between the developing container 18 and a peripheral surface of the developing roller 17, a flexible end portion seal member 80 formed with felt, pile fabric or the like at a surface thereof slidable with the developing roller 17 is provided and seals the gaps. The end portion seal member 80 fills a gap among the developing roller 17, the developing unit 4 and the back surface (opposite from the contact surface with the developing roller 17) of the developing blade 21. The end portion seal member 80 is press-contacted to the peripheral surface of the developing roller 17 and the back surface of the developing blade, so that leakage of the toner in the longitudinal direction is prevented.

Structure of Developing Blade

Next, the developing blade (regulating member) which is feature of the present invention will be described.

Figure 4:
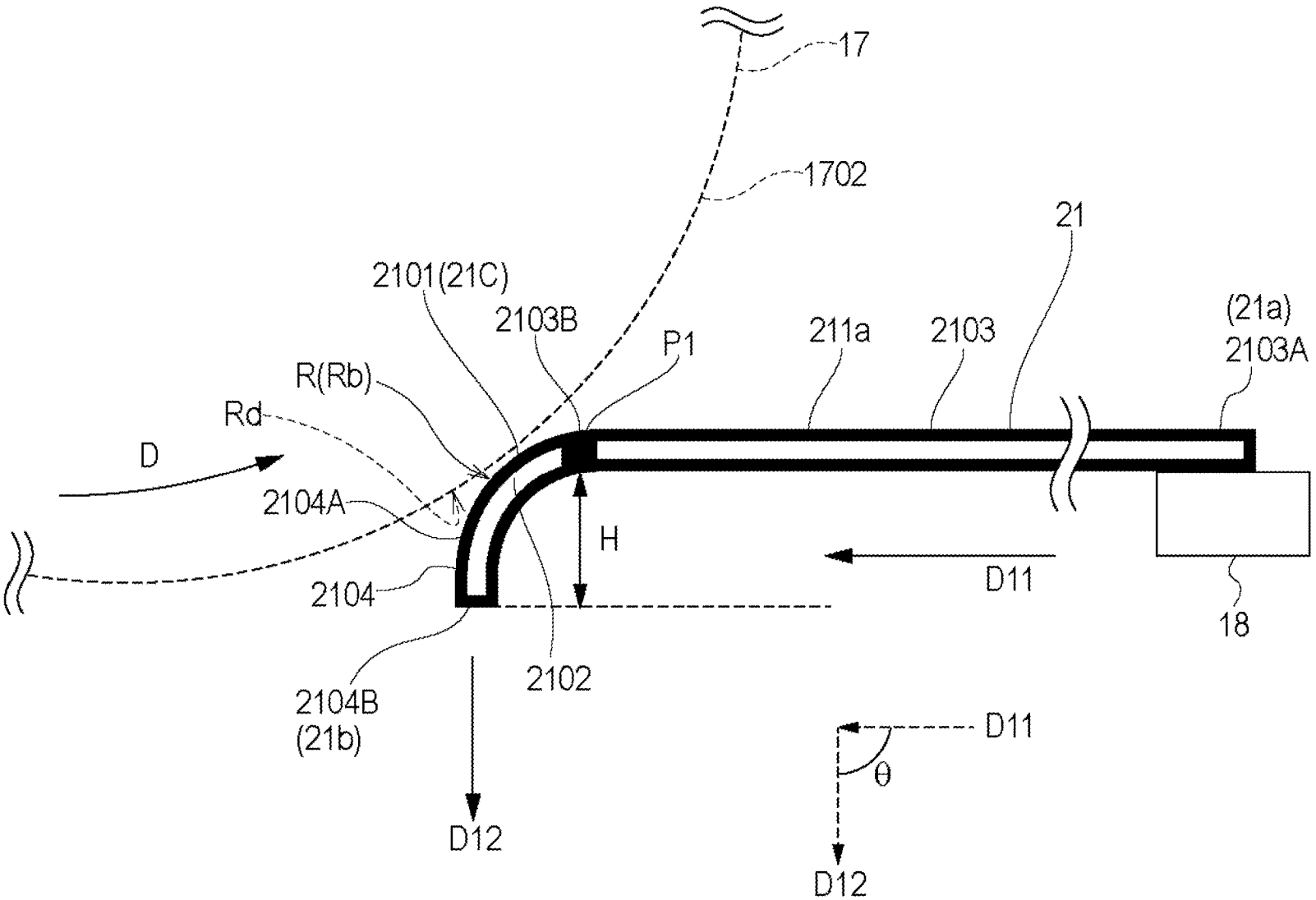
FIG. 4 is a schematic sectional view of a developing blade in the embodiment.

In this embodiment, as shown in FIG. 4, the developing blade 21 is disposed so as to extend in a counter direction to the rotational direction of the developing roller 17 and is a member for regulating the amount of the toner carried on the developing roller 17.

Further, when electric charges are imparted to the toner 40 by triboelectrically charging the toner 40 by rubbing the toner 40 with the developing blade 21 and the developing roller 17.

The developing blade 21 is fixed to the developing container 18 with a fastening tool such as a screw at one end portion 21*a* thereof with respect to a widthwise direction (D11) perpendicular to the longitudinal direction and has a free end at the other end portion 21*b*. The direction (D11) in which the developing blade 21 extends from one end 21*a* fixed to the developing container 18 toward the other end 21*b* contacting the developing roller 17 is an opposite direction (counter direction) to the rotational direction (D) of the developing roller 17 at a portion (2012) contacting the developing roller 17.

In this embodiment, as the developing blade 21, an elastic thin plate of SUS 304-1/2H formed in a leaf spring shape so as to have a free length of 8 mm in the widthwise direction and a thickness of 0.07 mm or more and 0.10 mm or less is used. Here, the developing blade 21 is not limited thereto, but may also be a thin metal plate of phosphor bronze, aluminum or the like.

The developing blade 21 is contacted at a free end (21*b*) side to the surface of the developing roller 17 with a pressing force which is linear pressure of 20-40 [N/m]. The developing blade 21 includes a rectilinear portion 211*a* extending linearly as shown in FIG. 4. Further, on the free end side of the rectilinear portion 211*a*, a bent portion 2102 arcuately bent from a bending start position P1 toward the free end 21*b* with a predetermined radius of curvature R (Rb) is formed.

Further, as shown in FIG. 4, the developing blade 21, the developing blade 21 has a distance H (including a blade thickness, hereinafter referred to as a height H), with respect to a perpendicular direction (direction perpendicular to the direction D11), from the linearly extending rectilinear portion 211*a* to the free end 21*b*, and has an angle θ [°] (between directions D11 and D12).

In the case where the height H of the developing blade 21 is made lower than 0.15 [mm], in order to ensure a bending margin, there is a need to cut the free end portion after bending the thin plate. For that reason, the cutting is expensive and unpreferable.

Further, in the case where the height H is made higher than 0.5 [mm], the gap among the developing unit 4, the developing blade 21 and the peripheral surface of the developing roller 17 cannot be completely sealed with the end portion seal member 80, so that the toner leakage occurs in the longitudinal direction in some instances. Accordingly, in this embodiment, the developing blade 21 which has the height H of 0.15 [mm]≤H ≤0.5 [mm] and which has the bending angle θ (between the directions D11 and D12) of 80°≤θ≤130° in order to obtain the predetermined radius of curvature was used.

A contact line 2101 of the bent portion 2102 of the developing blade 21 extends in a direction, from a front side to a rear side, perpendicular to the drawing sheet of FIG. 4, and the developing blade 21 contacts the surface of the developing roller 17 so that this contact line 2101 is perpendicular to a surface movement direction of the developing roller 17.

To the developing blade 21, a predetermined voltage is applied from an unshown blade bias voltage source, so that stabilization of toner coating is realized, and a voltage V=−500 V is applied as a blade bias.

Toner

Surface Layer Containing Organosilicon Polymer

In the case where toner particles has a surface layer containing an organosilicon polymer, the organosilicon polymer may preferably have a partial structure represented by the following formula (1):

$$R—SiO_{3/2} \qquad \text{formula (1)}$$

(R: hydrocarbon group having 1-6 carbon atoms)

In the organosilicon polymer having the structure of the formula (1), of four valences (bonds) of Si atoms, one is bonded to R and remaining three are bonded to oxygen (O) atom. The O atom is in a state in which both two valences (bonds) are bonded to the Si atom, i.e., constitutes siloxane bond (Si—O—Si). When the Si atoms and the O atoms in the organosilicon polymer are considered, two Si atoms are bonded to three 0 atoms, and therefore, this bonding portion is represented by $—SiO_{3/2}$. This $—SiO_{3/3}$ structure of the organosilicon polymer would be considered that the $—SiO_{3/2}$ structure has a properly similar to silica ($SiO_2$) constituted by many siloxane bonds. Accordingly, it would be considered that compared with toner having a surface layer formed of a conventional organic resin, the toner in this embodiment has a structure close to an inorganic substance, and therefore, it would be considered that a Martens hardness can be increased.

In the partial structure represented by the formula (1), R may preferably be a hydrocarbon group having 1-6 carbon atoms. As a result, a charge amount is easily stabilized. Particularly, R may preferably be an aliphatic hydrocarbon group having 1-5 carbon atoms or a phenyl group.

In the present invention, the above-described R may more preferably be a hydrocarbon group having 1-3 carbon atoms for the purpose of further improving chargeability. When the chargeability is good, a transfer property is good and an amount of transfer residual toner is small, and therefore, a degree of contamination of the charging member and the transfer member is remedied.

As the hydrocarbon group having 1-3 carbon atoms, methyl group, ethyl group, propyl group and vinyl group may preferable be cited. From the viewpoints of environment stability and storage stability, R may more preferably be methyl group.

As a manufacturing example of the organosilicon polymer, a sol-gel methods (process) is preferred. The sol-gel method is such that a liquid source is used as a starting material and is subjected to hydrolysis and condensation polymerization, and then gels through a sol state. The sol-gel method is used for synthesizing glass, ceramics, organic-inorganic hybrid and nanocomposite. By using this manufacturing method, it is possible to prepare functional materials having various forms, such as a surface layer, fibers, a bulk body and fine particles, from a liquid phase at low temperatures.

The organosilicon polymer existing in the surface layer of the toner particles may preferably be specifically formed by hydrolysis and condensation polymerization of a silicon compound represented by alkoxysilane.

The surface layer containing this organosilicon polymer is provided on the toner particles, whereby environment stability is improved, and a lowering in performance of the toner during long-term use does not readily occur, so that the toner excellent in storage stability.

Further, the sol-gel method forms a material by using a liquid as a starting material and then by subjecting the liquid to gelation, and therefore, various minute structures and shapes can be prepared. Particularly, in the case where the toner particles are manufactured in an aqueous solvent, the organosilicon polymer is easily precipitated on the surfaces of the toner particles by hydrophilicity of a hydrophilic group such as silanol group of an organosilicon compound. The above-described minute structures and shapes can be adjusted by a reaction temperature, a reaction time, a reaction solvent, pH, and kind and amount of an organometallic compound, and the like.

The organosilicon polymer of the surface layer of the toner particles may preferably be a polycondensation compound of an organosilicon compound having a structure represented by the following formula (Z):

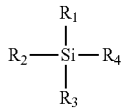

(Z)

In the formula (Z), $R_1$ represents a hydrocarbon group having one or more carbon atoms and six or less carbon atoms, and each of $R_2$, $R_3$ and $R_4$ independently represents halogen atom, hydroxy group, acetoxy group or alkoxy group.

By the hydrocarbon group (preferably alkyl group) of $R_1$, hydrophobicity can be improved, so that it is possible to obtain toner particles excellent in environment stability. Further, as the hydrocarbon group, it is also possible to use aryl group, for example, phenyl group, which is aromatic hydrocarbon group. In the case where the hydrophobicity of $R_1$ is large, there is a tendency that a degree of a fluctuation in charge amount becomes large in various environments, and therefore, in view of the environment stability $R_1$ may preferably be the hydrocarbon group having 1-3 carbon atoms, more preferably be methyl group.

Each of $R_2$, $R_3$ and $R_4$ is independently halogen atom, hydroxy group, acetoxy group or alkoxy group (hereinafter also referred to as reactive group). These reactive groups are subjected to hydrolysis, addition polymerization and polycondensation, so that a cross-linked structure and thus toner excellent in contamination resistance to members and development durability can be obtained. From the viewpoints that hydrolyzability is moderate at room temperature and of a precipitation property and a coating property to the surfaces of the toner particles, $R_2$, $R_3$ and $R_4$ may preferably be alkoxy group having 1-3 carbon atoms, may more preferably be methoxy group or ethoxy group. Further, the hydrolysis, the addition polymerization and the polycondensation of $R_2$, $R_3$ and $R_4$ can be controlled by a reaction temperature, a reaction time, a reaction solvent and pH.

In order to obtain the organosilicon polymer used in the present invention, one or a plurality of kinds of organosilicon compounds each having three reactive groups ($R_2$, $R_3$ and $R_4$) excluding $R_1$ in (one) molecule represented by the above-described formula (Z) may preferably be used.

Further, content of the organosilicon polymer in the toner particles may preferably be 0.5 wt. % or more and 10.5 wt. % or less.

When the organosilicon polymer content is 0.5 wt. % or more, surface free energy of the surface layer can be further reduced and flowability is improved, so that contamination of the members and an occurrence of a fog can be suppressed. When the organosilicon polymer content is 10.5 wt. % or less, charge-up can be made hard to occur. The organosilicon polymer content can be controlled by a kind and an amount of the organosilicon compound used for forming the organosilicon polymer, and a toner particle manufacturing method, a reaction temperature, a reaction time, a reaction solvent and pH during formation of the organosilicon polymer.

The surface layer containing the organosilicon polymer and toner core particles may preferably be contacted to each other with no gap. As a result, an occur of bleeding of a resin component and a parting agent and the like contained inside the surface layer of the toner particles is suppressed, so that it is possible to obtain toner excellent in storage stability, environment stability and development durability. In the surface layer, in addition to the organosilicon polymer, resin materials such as styrene-acrylic copolymer resin, polyester resin and urethane resin, and various additives and the like may also be added.

The toner particles contain a binder resin. The binder resin is not particularly limited, but a conventionally known binder resin can be used. The binder resin may preferably be vinyl resin, polyester resin and the like.

Manufacturing Method of Toner Particles

As the manufacturing method of the toner particles, known means can be used, so that a kneading pulverization method and a wet manufacturing method can be used. From the viewpoints of uniformization of a particle size and a shape control property, the wet manufacturing method may preferably be used. Further, as the wet manufacturing method, it is possible to cite a suspension polymerization method, a dissolution suspension method, emulsion polymerization aggregation method, emulsion aggregation method, and the like.

In this embodiment, the suspension polymerization will be described. In the suspension polymerization, first, a polymerizable monomer for forming the binder resin and other additives such as a colorant as desired are uniformly dissolved or dispersed using a dispersing device such as a ball mill or an ultrasonic dispersing device, so that a polymerizable monomer composition is prepared (preparation step), i.e., a "preparation step of polymerizable monomer composition". At this time, as desired, a multi-functional monomer, a chain transfer agent, was as the parting agent, a charge control agent, a plasticizer and the like can be appropriately added.

Then, the above-described polymerizable monomer composition is added into an aqueous solvent, and droplets of the polymerizable monomer composition are formed in toner particles having a desired size by a stirring machine or a dispersing machine with a high shearing force (granulation step).

The aqueous solvent in the granulation step may preferably contain a dispersion stabilizer from the viewpoints of particle control of the toner particles, sharpening of a particle size distribution and suppression of coalescence of the toner particles in a manufacturing process.

The dispersion stabilizer is roughly classified in general into a polymer exhibiting a repelling force due to a steric hindrance and a poorly water-soluble inorganic compound for realizing dispersion stabilization with an electrostatic repelling force. Fine particles of the poorly water-soluble inorganic compound is dissolved by acid and alkali, and therefore can be easily removed by being dissolved by washing with the acid or the alkali after the polymerization, and thus are suitably used.

After the granulation or while performing the granulation step, polymerization of the polymerizable monomer contained in the polymerizable monomer composition is performed at a predetermined temperature preferably set at 50° C. or more and 90° C. or less, so that a dispersion liquid of the toner particles is obtained (polymerization step).

In the polymerization step, a stirring operation may preferably be performed so that a temperature distribution in a container becomes uniform. In the case where a polymerization initiator is added, the addition can be carried out with arbitrary timing and required time. Further, for the purpose of obtaining a desired molecular weight distribution, the reaction temperature may also be increased in the latter stage of the polymerization reaction, and in order to remove an unreacted polymerizable monomer, a by-product and the like to an outside of a system, a part of the aqueous solvent may also be distilled away by a distilling operation in the latter stage of the reaction or after an end of the reaction. The distilling operation can be performed under normal pressure or reduced pressure.

A particle size of the toner particles may preferably be 3.0 μm or more and 10.0 μm or less in weight-average particle size from the viewpoint such that an image with high precision and high resolution is formed. The weight-average particle size can be measured by a pore electric resistance method. For example, the weight-average particle size can be measured using "Coulter Counter Multisizer 3", manufactured by Beckman Coulter K.K.). The thus-obtained toner particle dispersion liquid is subjected to a filtration step in which the toner particles and the aqueous solvent are separated from each other by solid-liquid separation.

The solid-liquid separation for obtaining the toner particles from the toner particle dispersion liquid can be performed by a general-purpose filtration method, and thereafter in order to remove a contaminant which cannot be completely removed from the surfaces of the toner particles, washing may preferably be further carried out by reslurry or watering with washing water. After sufficient washing is performed, the solid-liquid separation is further performed, so that a toner cake is obtained. Thereafter, the toner cake is dried by a known drying means, and as needed, a particle group having a particle size other than a predetermined particle size is separated by classification, so that the toner particles are obtained. The particle group which is separated at that time and which has the particle size other than the predetermined particle size may also be utilized again in order to improve a final yield.

In the case where the surface layer containing the organosilicon polymer is formed, when the toner particles are formed, the surface layer can be formed by adding a hydrolyzed liquid of the organosilicon polymer as described above while performing the polymerization step in the aqueous solvent. A dispersion liquid of the toner particles after the polymerization is used as a core particle dispersion liquid, and the hydrolyzed liquid of the organosilicon compound is added, so that the surface layer may also be formed. Further, in the case of the kneading pulverization method or the like other than the method using the aqueous solvent, resultant toner particles are dispersed in the aqueous solvent to prepare a core particle dispersion liquid. By using the core particle dispersion liquid, the hydrolyzed liquid of the organosilicon compound is added as described above, so that the surface layer can be formed.

Measuring method of Martens Hardness

Hardness is one of mechanical property of a surface of a substance or the neighborhood of the surface and represents a hardly deformable degree of the substance and a hardly damaged degree of the substance when the substance is deformed or damaged by a foreign matter. Various measuring methods and definitions of the hardness exist. For example, the measuring methods are used for difference purposes depending on an area of a measuring region, and in many instances, Vickers method is used in the case where the measuring region is 10 μm or more, a nanoindentation method is used in the case where the measuring region is 10 μm or less, an AFM is used in the case where the measuring region is 1 μm or less, and the like. As regards the definitions, for example, Brinell hardness and Vickers hardness are used as indentation hardness, Martens hardness is used as scratch hardness, and Shore hardness is used as rebound hardness, for different purposes.

For measurement of the hardness of the toner (toner particles), the general particle size is 3 μm-10 μm, and therefore, the nanoindentation method is preferably used measuring method. According to study by the present inventors, as the definition of the hardness for achieving an effect of the present invention, the Martens hardness representing the scratch hardness was appropriate. This would be considered because hardness capable of representing strength against scratch of the toner by a hard substance such as metal, an external additive or the like in the developing device is the scratch hardness.

In the nanoindentation method, the Martens hardness of the toner can be calculated (measured) from a load-displacement curve in accordance with a procedure of an indentation test defined in ISO14577-1 in a commercially available device in conformity with ISO14577-1. In the present invention, as the device in conformity with the above-described ISO standard, a nanoindentation tester ("ENT-1100b", manufactured by ELONIX INC.) was used. A measuring method is described in "ENT-1100 operation manual" attached to the tester, but a specific measuring method is as follows.

A measuring environment was such that an inside of a shield care was kept at 30° C. in an attached temperature control device. Maintenance of an ambient temperature at a certain temperature is effective in reduction of a fluctuation in measurement data due to thermal expansion and drift. A set temperature was 30° C. as a condition in which a temperature in the neighborhood of the developing device in which the toner is rubbed is assumed. As a test table, a standard test table attached to the tester was used, and toner was applied onto the table and thereafter weak air is blown to the toner so as to distribute the toner. Then, the test table was set in the tester and was held for 1 hour or more, and then the measurement was performed.

The measurement was performed using, as an indenter, a flat indenter (titanium indenter with diamond tip) having a flat surface of 20 μm square as a tip thereof. For a spherical substance with a small diameter, a substance on which an external additive is deposited, and a substance with surface unevenness, such as the toner, when a pointed indenter is used, the pointed indenter has the influence on measurement accuracy, and therefore, the flat indenter is used. A maximum load in the test was set at $2.0\times10^{-4}$ N, and the test was conducted. By setting the maximum load as a test load, it is possible to measure the hardness without breaking the toner surface layer under a condition corresponding to stress exerted on (one) toner particle in the developing portion. In the present invention, abrasion resistance is important, and therefore, it is important that the hardness is measured while maintaining the surface layer without breaking the surface layer.

As the toner particles as an object to be measured, the toner particles in which a single toner particle exists in a measurement screen (viewing size: lateral dimension of 160 μm, vertical dimension of 120 μm) observed through a microscope attached to the tester. However, in order to minimize an error of a displacement amount, the toner particle with a particle size (diameter) (D) falling within a range of ±0.5 μm of a number-average particle size (D1) ($D1-0.5\ \mu m \le D \le D1+0.5\ \mu m$) was selected. Incidentally, for particle size measurement of a measurement object particle, a long diameter and a short diameter of the toner particle were measured using a software attached to the tester, and the particle size D (μm) was determined by [(long diameter)+(short diameter))/2]. Further, the number-average particle size was measured by the "Coulter Counter Multisizer 3" (manufactured by Beckman Coulter K.K.) in a method described later.

For the measurement, arbitrary 100 toner particles each satisfying the above-described condition of the particle size D (μm) were selected and subjected to the measurement. Conditions inputted for the measurement are as follows.

Test mode: loading-unloading test

Test load: 20,000 mgf (=$2.0\times10^{-4}$ N)

Number of division: 1000 steps

Step interval: 10 msec

When an analyzing menu "Data analysis (ISO)" is selected and the measurement is made, the Martens hardness is analyzed by and outputted from the software attached to the tester after the measurement. The above-described measurement was carried out for the 100 toner particles, an arithmetic mean (average) thereof was taken as the Martens hardness in the present invention.

By adjusting the Martens hardness, measured under the condition of a maximum load of $2.0\times10^{-4}$ N of the toner, to 200 MPa or more and 1100 MPa or less, an anti-wearing property of the toner at the developing portion was able to be considerably improved compared with the conventional toner. As a result, it become possible to enhance a degree of freedom of process design for speed-up and image quality improvement.

That is, a latitude of selection such as increases in a regulating blade nip width, a developing roller rotational speed and a carrier mixing and stirring speed is broadened. As a result, the charge amount was able to be maintained while suppressing "development stripe" due to abrasion of the member. Accordingly, an occurrence of density non-uniformity was able to be suppressed.

In the case where the Martens hardness is lower than 200 MPa, the toner cannot withstand shearing with the developing blade as a charge-imparting member, so that the toner charge amount lowered and the density non-uniformity due to potential non-uniformity and falling of the toner occurred. A preferred value of the Martens hardness is 250 MPa or more, and a more preferred value of the Martens hardness is 300 MPa or more.

On the other hand, in the case where the Martens hardness is higher than 1100 MPa, the developing blade and the developing roller were damaged and the "development stripe" occurred. A preferred value of the Martens hardness is 1000 MPa or less, and a more preferred value of the Martens hardness is 900 MPa or less.

A means for adjusting the Martens hardness, measured under the condition of the maximum load of $2.0\times10^{-4}$ N, to 200 MPa or more and 1100 MPa or less is not particularly limited. However, this hardness is remarkably harder than the hardness of an organic resin material used in a general-purpose toner, and therefore, it is difficult to achieve the above-described range of the Martens hardness by a means ordinarily carried out for increasing the hardness. For example, it is difficult to achieve the above-described range of the Martens hardness by a means for providing design of a resin material having a high glass transition temperature, a means for increasing a molecular weight of a resin material, a thermally hardening means, a means for adding a filler to the surface layer and the like means.

When the Martens hardness of the organic resin material used for the general-purpose toner is about 50 MPa-80 MPa as measured under the condition of the maximum load of $2.0\times10^{-4}$ N. Further, even in the case where the hardness is increased by the resin design, an increase in molecular weight, or the like, the Martens hardness is about 120 MPa or less. Further, even in the case where a filler such as a magnetic material or a silicon compound is filled in the neighborhood of the surface layer and is thermally hardened, the resultant Martens hardness is about 185 MPa at the maximum, and therefore, the toner in the present invention is considerably harder than the general-purpose toner.

Control Method of Hardness

As one of means for adjusting the Martens hardness to the above-described specific range, for example, a method in which the surface layer of the toner is formed of a substance such as an organic substance with proper hardness and in which a chemical structure and a macrostructure thereof are controlled so as to have proper hardness is cited.

As a specific example, it is possible to cite an organosilicon polymer as a substance capable of having the above-described specific hardness, and it becomes possible to adjust the hardness, as selection of the material, the number and a chain length of carbon atoms directly bonded to silicon atom of the organosilicon polymer.

The toner particles have the surface layer containing the organosilicon polymer. When the number of carbon atoms directly bonded to the silicon atom of the organosilicon polymer is 1 or more and 3 or less per (one) silicon atom in average (preferably 1 or more and 2 or less, more preferably 1), the resultant organosilicon polymer is preferred since the Martens hardness is easily adjusted to the above-described specific range.

As a means for adjusting the Martens hardness by the chemical structure, the Martens hardness can be adjusted by the chemical structure such as cross-linking, a degree of polymerization and the like of a surface layer substance. As a means for adjusting the Martens hardness by the macrostructure, the Martens hardness can be adjusted by an uneven shape of the surface layer, a network structure connecting projections of the surface layer. In the case where the organosilicon polymer is used in the surface layer, these adjusts can be made by pH, concentration, a temperature, a time and the like when the organosilicon polymer is subjected to a pre-process. Further, it is possible to adjust the Martens hardness by timing, form, concentration, reaction temperature, and the like of formation of the surface layer of the organosilicon polymer on the core particles of the toner.

In the present invention, the following method is particularly preferred. First, core particles of the toner containing the binder resin are manufactured and dispersed in the aqueous solvent, so that a core particle dispersion liquid is obtained. A concentration at this time may preferably be such that a solid content of the core particles per a total amount of the core particle dispersion liquid is 10 wt. % or more and 40 wt. % or less. Further, a temperature of the core particle dispersion liquid may preferably be adjusted at 35° C. or more in advance. Further, pH of the core particle dispersion liquid may preferably be adjusted at pH where condensation of the organosilicon compound does not readily proceed. The pH where the condensation does not readily proceed is different depending on the substance, and therefore, the pH may preferably be in a range of ±0.5 of the pH where the reaction does not most readily proceed.

On the other hand, the organosilicon compound may preferably be used after being subjected to a hydrolysis process. For example, as a pre-process of the organosilicon compound, the organosilicon compound has been hydrolyzed in another container in advance. In the case where an amount of the organosilicon compound is 100 wt. parts, a preparation concentration for hydrolysis may preferably be 40 wt. parts or more and 500 wt. parts or less, more preferably be 100 wt. parts or more and 400 wt. parts or less, of water from which ionic component is removed, such as ion-exchange water or RO (reverse osmosis) water. As a condition of the hydrolysis, it is preferable that pH is 2-7, a temperature is 15-80° C. and a time is 30-600 min.

The resultant hydrolyzed liquid and the core particle dispersion liquid are mixed, and pH of a mixture is adjusted to pH (preferably be 6-12 or 1-3, more preferably 8-12) suitable for the condensation, so that the organosilicon compound can be formed as the surface layer on the core particle surfaces of the toner while being subjected to condensation. The condensation and the formation of the surface layer may preferably be performed at 35° C. or more for 60 minutes or more. Further, before adjusting the pH to the pH suitable for the condensation, by adjusting a time for which the above-described mixture is kept at 35° C., the macrostructure of the surface layer can be adjustable, but the time may preferably be 3 minutes or more and 120 minutes or less in order to facilitate obtainment of the specific Martens hardness.

By the above-described means, a reaction residual group can be reduced, unevenness can be formed on the surface layer, and further a network structure can be formed between projections, and therefore, the toner having the above-described specific Martens hardness is easily obtained. In the case where the surface layer containing the organosilicon polymer is used, a fixing ratio of the organosilicon polymer may preferably be 90% or more and 100% or less, more preferably be 95% or more and 100% or less. A measuring method of the organosilicon polymer will be described below.

Measuring Method of Fixing Ratio of Organosilicon Polymer

In 100 ml of ion-exchange water, 160 g of sucrose (manufactured by Kishida Kagaku Co., Ltd.) was added and dissolved while being warmed in a vessel in hot water, so that a concentrated liquid of sucrose was prepared. In a tube (volume: 50 ml) for centrifugal separation, 31 g of the concentrated liquid of sucrose and 7 ml of "Contaminon N" (10%-aqueous solution of neutral detergent, for washing precision measurement equipment, of pH 7 consisting of a nonionic surfactant, an anionic surfactant and an organic builder, manufactured by JUJIFILM Wako Pure Chemical Corp.) were placed, and a dispersion liquid was prepared. In this dispersion liquid, 1.0 g of the toner was added, and agglomeration of the toner was loosened by a spatula or the like.

The tube for centrifugal separation was shaken for 20 min. in a shaker at 350 spm (strokes per min). After the shaking, the solution was discharged from the tube for centrifugal separation and charged (added) in a glass tube (volume: 50 ml) for swing rotor, and was subjected to centrifugal separation at 3500 rpm for 30 minutes by a centrifugal separator ("H-9R", manufactured by KOKUSAN Co., Ltd.). Sufficient separation between the toner and the aqueous solution was observed with eyes, and the toner separated as an uppermost layer was collected by the spatula or the like. An aqueous solution containing the collected toner was filtered by a vacuum filter and thereafter was dried for 1 hour or more by a drier. A dried product was pulverized by the spatula and was subjected to measurement of an amount of silicon through fluorescent X-rays. The fixing ratio (%) was calculated from a ratio of element content between measurement objects of the toner after washing with water and the toner in an initial stage.

Measurement of respective elements is in conformity with JIS K0119-1969, but is specifically as follows.

As a measuring device, a wavelength dispersive fluorescent X-ray analyzer ("Axios", manufactured by Malvern Panalytical Ltd.) and a software ("Super Q ver. 4.0F", manufactured by Malvern Panalytical Ltd.) attached to the analyzer for setting measurement condition and for analyzing measurement data were used. Incidentally, as an anode of an X-ray tube, Rh was used, and a measurement atmosphere was vacuum. A measurement diameter (collimator mask diameter) was 10 mm, and a measurement time was 10 sec. Further, in the case where light elements were measured, detection was made using a proportional counter (PC). In the case where heavy elements were measured, detection was made using a scintillation counter (SC).

As a measurement sample, about 1 g of each of the toner after the washing and the initial-stage toner was placed in a dedicated pressing aluminum ring of 10 mm in diameter and then was flattened. Then, using a tablet briquetting press ("BRE-32", Maekawa Testing Machine MFG. Co. LTD.), the toner was pressed at 20 MPa for 60 sec., and was molded in a pellet of about 2 mm in thickness. The pellet was used as the measurement sample.

The measurement was carried out under the above-described condition, and elements, were identified on the basis of resultant X-ray peak positions, and a concentration of each of the elements was calculated from a counting rate (unit: cps) which is the number per unit time of X-ray photons.

As a quantitative method of the element in the toner, for example, as regards a silicon amount, 0.5 wt. part of silica ($SiO_2$) fine powder was added to 100 wt. parts of toner particles, and these particles were sufficiently mixed using a coffee mill. Similarly, each f 2.0 wt. parts and 5.0 wt. parts of the silica fine powder was mixed with 100 wt. parts of toner particles. The resultant three samples were used as samples for a calibration curve.

For each of the samples, a sample pellet for the calibration curve was prepared using the tablet briquetting press in the above-described manner, and a counting rate (unit: cps) of Si-K$\alpha$ ray measured at a diffraction angle (2$\theta$)=109.08° when PET was used as an analyzing (dispersion) crystal. At this time, acceleration voltage and current values of an X-ray generator were 24 kV and 100 mA, respectively. A calibration curve of linear function in which the ordinate represent the counting rate of the resultant X-ray and the abscissa represents an addition amount of $SiO_2$ in each of the samples for the calibration curve.

Then, the toner to be analyzed was formed in a pellet using the tablet briquetting press in the above-described manner, and the counting rate of Si-K$\alpha$ ray of the pellet was measured. Then, a content of the organosilicon polymer in the toner was acquired from the above-described calibration curve. A ratio of the element content of the washed toner calculated by the above-described method to the element content of the initial-stage toner calculated by the above-described method was acquired and was used as the fixing ratio (%).

Toner

Figure 5:
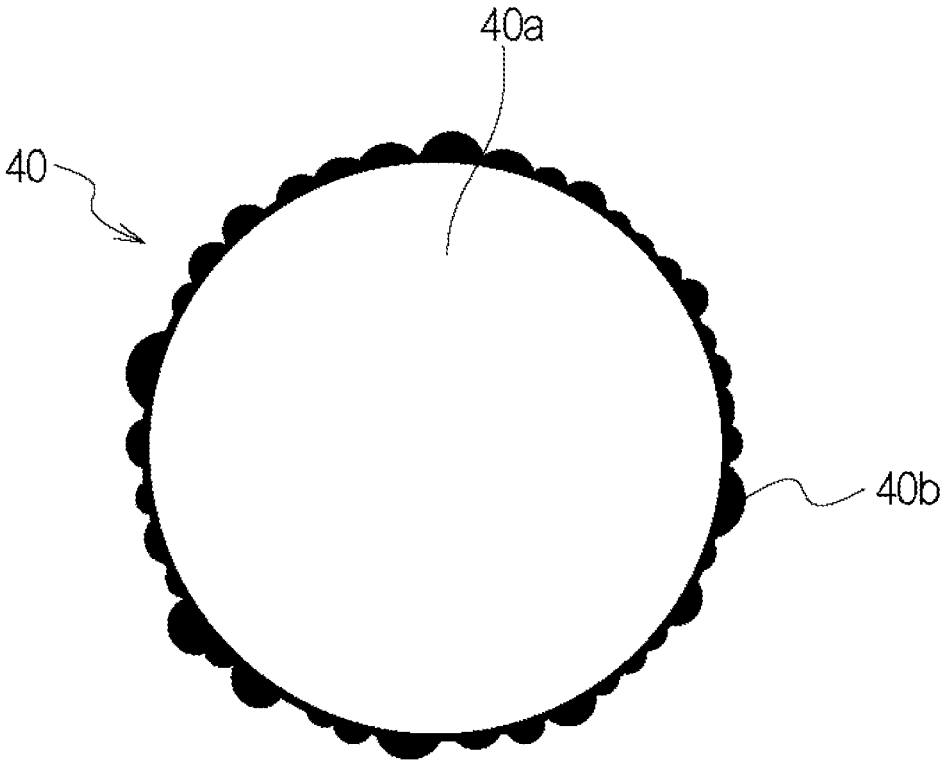
FIG. 5 is a schematic view of toner including a surface layer containing an organosilicon compound in the embodiment.

A schematic view of the toner 40 used in this embodiment is shown in FIG. 5. In this embodiment, toner particles each including a base particle 40*a* and a surface layer 40*b* containing the organosilicon polymer are used.

In the following, "parts (part)" of respective ingredients are all on the basis of a weight unless otherwise specified.

Preparation Step of Aqueous Solvent 1

In 1000.0 parts of ion-exchange water in a reaction container (vessel), 14.0 parts of sodium phosphate (dodecahydrate, manufactured by RASA Industries, LTD.) was added and was kept at 65° C. for 1.0 hour while purging nitrogen.

While stirring the mixture at 12000 rpm by using T.K. homomixer (manufactured by PRIMIX Corp.), calcium chloride aqueous solution prepared by dissolving 9.2 parts of calcium chloride (dihydrate) in 10.0 parts of ion-exchange water was added all together, so that an aqueous solvent containing a dispersion stabilizer was prepared. Further, in the aqueous solvent, 10 wt. %-hydrochloric acid was added and pH thereof was adjusted to 5.0, so that an aqueous solvent 1 was prepared.

Hydrolyzing Step of Organosilicon Compound for Surface Layer

In a reaction container provided with a stirrer and a thermometer, 60 parts of ion-exchange water was weighed and pH was adjusted to 3.0 by using 10%-hydrochloric acid. Thus liquid was heated while being stirred until a temperature thereof reached 70° C. Thereafter, 40.0 parts of methyltriethoxysilane which is the organosilicon compound for the surface layer was added to the liquid and was stirred for 2 hours or more, and thus hydrolysis was carried out. An end point of the hydrolysis was confirmed by that oily water was not separated and forms a single layer, and then the liquid was cooled, so that a hydrolyzed solution of the organosilicon compound for the surface layer was obtained.

Preparation Step of Polymerizable Monomer Composition

| | |
|---|---|
| Styrene | 60.0 parts |
| C.I. Pigment Blue 15:3 | 6.5 parts |

These ingredients were added in an attritor (manufactured by NIPPON COKE & ENGINEERING. CO., LTD.), and were dispersed at 220 rpm for 5.0 hours by using zirconia particles of 1.7 mm in diameter, so that a pigment dispersion liquid was prepared. In the pigment dispersion liquid, the following ingredients were added.

| | |
|---|---|
| Styrene[ | 20.0 parts |
| n-butylacrylate | 20.0 parts |
| Cross-linking agent (divinylbenzene) | 0.3 part |

Saturated polyester resin (polycondensation product of propylene oxide-modified bisphenol A (2 mol adduct) and terephthalic acid (molar ratio=10:12), glass transition temperature Tg=68° C., weight-average molecular weight

| | |
|---|---|
| Mw = 10000, molecular weight distribution Mw/Mn = 5.12) | 5.0 parts |
| Fischer-Tropsh wax (melting point: 78° C.) | 7.0 parts |

These were kept at 65° C. and were uniformly dissolved and dispersed by the T.K. homomixer at 500 rpm, so that a polymerizable monomer composition was prepared.

Granulation Step

The polymerizable monomer composition was added in the aqueous solvent 1 while keeping the temperature of the aqueous solvent 1 at 70° C. and keeping the number of revolutions of the T.K. homomixer at 12000 rpm, and then 9.0 parts of t-butyl peroxypivalate which was a polymerization initiator was added. Then, the mixture was granulated for 10 minutes in the stirring device (T.K. homomixer) while keeping 12000 rpm.

Polymerization Step

After the granulation, the stirrer was replaced with a propeller stirring blade, and polymerization was performed for 5 hours while keeping 70° C. and stirring the mixture at 150 rpm, and then the temperature was increased up to 85° C. and the mixture was heated for 2.0 hours, so that polymerization reaction was conducted and thus core particles were obtained. When the temperature of the slurry (mixture) was decreased to 55° C. and pH was measured, the pH was 5.0. In the slurry, 20.0 parts of the hydrolyzed solution of the organosilicon compound for the surface layer was added while maintaining the stirring at 55° C., and then formation of the surface layer of the toner particles was started. After the mixture was held for 30 minutes as it is, the pH of the slurry was adjusted to pH=9.0 for completing condensation by using a sodium hydroxide aqueous solution, and then was held further for 300 minutes, so that the surface layer was formed.

Washing and Drying Step

After an end of the polymerization step, the slurry of the toner particles was cooled, and hydrochloric acid was added in the slurry of the toner particles and adjusted the pH of the slurry at pH=1.5. The slurry was stirred and left standing for 1 hour and then was subjected to solid-liquid separation by a pressure filter, so that a toner cake was obtained. This toner cake was re-slurred by ion-exchange water, so that the dispersion liquid was prepared again. Then, the dispersion liquid was subjected to solid-liquid separation by the above-described filter. The re-slurring and the solid-liquid separation were repeated until electric conductivity of filtrate was 5.0 μS/cm, and thereafter the dispersion liquid was finally subjected to the solid-liquid separation, so that a toner cake was obtained.

The resultant toner cake was dried by a flushed drier ("Flush Jet Drier", manufactured by SEISHIN ENTERPRISE Co., Ltd.) and then fine and coarse particles were classified by a multi-division classifier utilizing the Coanda effect, so that toner particles 1 were obtained. A drying condition was such that a blowing temperature was 90° C. and a drier outlet temperature was 40° C., and a toner cake feeding speed was adjusted, depending on water content, to a speed such that the outlet temperature was not deviated from 40° C.

In this embodiment, the resultant toner particles 1 were used as toner a as they were without adding an external additive thereto. Further, toner b, toner c and toner d were prepared by changing a condition when the hydrolyzed solution (in the polymerization step) and a retention time after the addition as shown in a Table 1 appearing hereinafter. Incidentally, the pH adjustment of the slurry was performed with hydrochloric acid and sodium hydroxide aqueous solution.

Toner e was not subjected to the hydrolyzing step of the organosilicon compound for the surface layer. Instead, 15 parts of methyltriethoxysilane which was the organosilicon compound was added in a monomer state as it was in the preparation step of the polymerizable monomer composition. In the polymerization step, the methyltriethoxysilane was cooled to 70° C. and was subjected to pH measurement, and thereafter the addition of the hydrolyzed solution thereto was not made. The pH of the resultant slurry was adjusted to 9.0 for condensation by using the sodium hydroxide aqueous solution while stirring the slurry at 70° C., and then the slurry was further held for 300 minutes, so that the surface layer was formed. The toner e was prepared in the same manner as the above-described Ta except fa the above-described steps.

In this embodiment, each of the toners a to e was used as it was without adding the external additive, but the external additive may also be used.

TABLE 1

| | PI*1 | CRA*2 | OSC*3 | Condition*4 | | | CD*5 |
|---|---|---|---|---|---|---|---|
| Toner | (parts) | (part) | kind | pH | Temp. | (parts) | Time |
| a | 9.0 | 0.3 | MTS | 7.0 | 65 | 20 | 3 |
| b | 9.0 | 0.5 | MTS | 5.0 | 55 | 20 | 30 |
| c | 9.0 | 0.3 | MTS | 5.0 | 40 | 20 | 90 |

TABLE 1-continued

| Toner | PI*1 (parts) | CRA*2 (part) | OSC*3 kind | Condition*4 pH | Condition*4 Temp. | Condition*4 (parts) | CD*5 Time |
|---|---|---|---|---|---|---|---|
| d | 9.0 | 0.3 | MTS | 5.0 | 35 | 20 | 150 |
| e | 9.0 | 0.3 | MTS | | Not hydrolyzed*6 | | |

*1"PI" represents an addition amount of the polymerization initiator.

*2"CRA" represents an addition amount of the cross-link agent.

*3"OSC" represents the organosilicon compound for the surface layer. "MTS" represents the methyltriethoxysilane.

*4"Condition" represents the condition when the hydrolyzed solution was added. "pH" is the slurry pH. "Temp." is the slurry temperature. "(parts)" is the addition amount of the hydrolyzed solution.

*5"CD" represents the condition after the addition of the hydrolyzed solution. "Time" is the retention until the pH adjustment for completing the condensation.

*6"Not hydrolyzed" represents that the methyltriethoxysilane was not hydrolyzed and was added in the dissolution (preparation) step.

Measurement of the particle size, the Martens hardness and the fixing ratio was carried out by the methods described above. In a Table 2, measured values of the Martens hardness of the toners a to e are shown.

TABLE 2

| Toner | MH*1 (MPa) |
|---|---|
| a | 251 |
| b | 606 |
| c | 1092 |
| d | 1200 |
| e | 185 |

*1"MH" represents the Martens hardness under maximum load of $2.0 \times 10^{-4}$N.

Experiment Contents 1

In the constitution of this embodiment, the following experiment was conducted.

A plurality of developing blades 21 different in radius of curvature R [mm] were prepared (Table 3 appearing hereinafter). For each of the developing blades 21, a radius of curvature R [mm] and a height H [mm] of an outer peripheral curved surface (2102A) of a curved surface portion (bent portion) (2102) (see FIG. 4), and a ten-point average roughness were measured by a shape measuring microscope ("UK-X200", manufactured by KEYENCE Corp.).

Figure 6A:
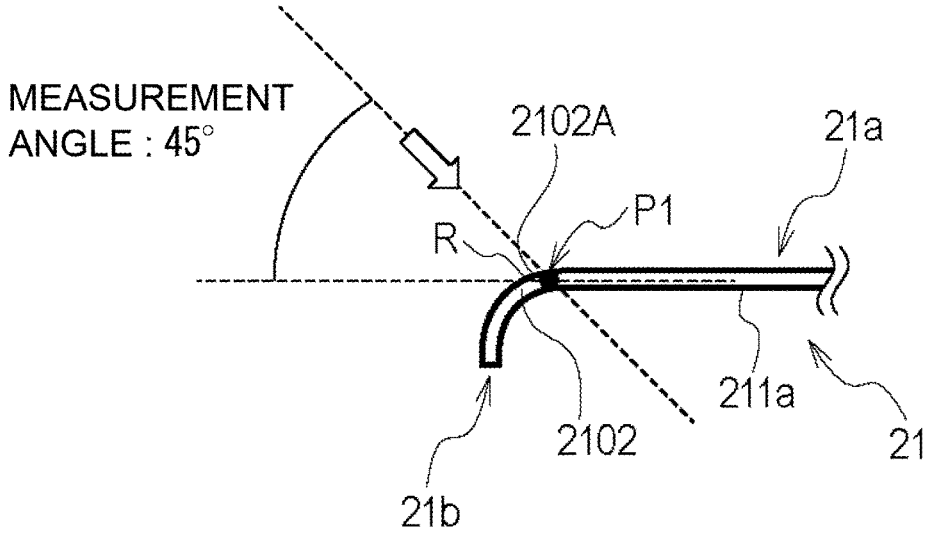
FIG. 6A is a schematic view for illustrating a measuring method of a radius of curvature R of a bent portion of the developing blade in the embodiment.

FIG. 6A is a schematic view showing a measurement angle when the curved surface portion (2102) of the blade b by the shape measuring microscope. to The curved surface portion (2102) of the developing blade 21 was observed obliquely at the measurement angle of 45°.

Figure 6B:
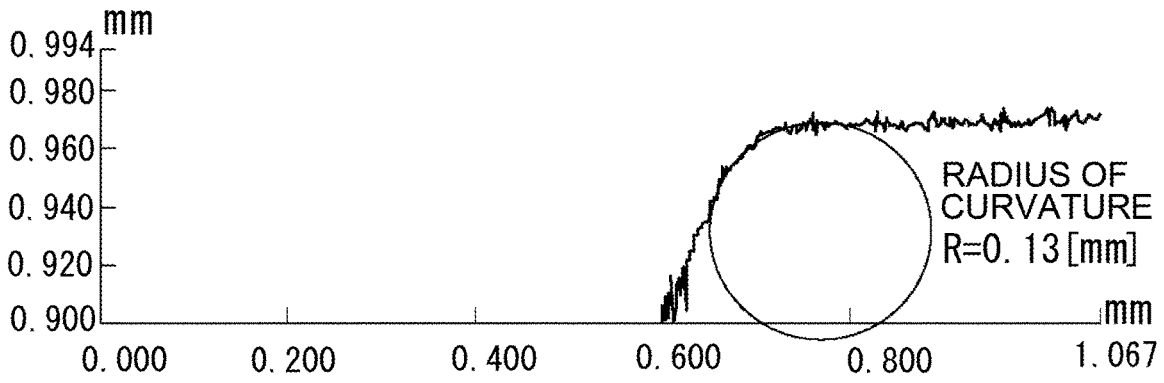
FIG. 6B is a schematic view showing a measurement result of the radius of curvature R.

FIG. 6B is a schematic view showing a detection result of a radius of curvature R [mm] (Rb) of the outer periphery curved surface (2102A) of the curved surface portion (2102) of the blade by measured by the shape measuring microscope.

As regards all the radius of curvature R [mm], the height H [mm] and the ten-point average roughness Rz of the outer peripheral curved surface (2102A) of the curved surface portion (2102) which were shown in the table 3, measurement was made with the observation angle shown in FIG. 5.

As shown in the table 3, it is understood that Rz increases with a decreasing radius of curvature R [m] (Rb) of the outer peripheral curved surface (2102A) of the curved surface portion (2102). That is, with the decreasing radius of curvature R [mm], projections become high and the toner is liable to stagnate at the projections, so that the toner is liable to fuse.

TABLE 3

| Blade | R [mm] | H [mm] | Rz |
|---|---|---|---|
| a | 0.08 | 0.3 | 10.33 |
| b | 0.13 | 0.3 | 8.37 |
| c | 0.3 | 0.3 | 4.04 |
| d | 0.5 | 0.3 | 2.97 |

By using the toners a to e shown in the table 2 and the blades a to d shown in the table 3, "development stripe" and "falling" were evaluated.

An evaluation condition was such that the above-described evaluation was performed after the image forming apparatus was left standing overnight in a normal temperature/normal humidity (25° C./50% RH) environment and thus was sufficiently adapted to the environment and then was subjected to image formation such that experimental images were intermittently formed on 10000 sheets of the recording materials (durability test). In this embodiment, the experimental image was a lateral line of 5% in an image print ratio.

Evaluation methods will be described.

Evaluation of Development Stripe

A halftone image (toner application amount: 0.2 mg/cm$^2$) was printed on letter-sized paper ("Vitabity Paper", manufactured by Xerox Corp., basis weight: 75 g/m$^2$), and the development stripe was evaluated in the following ranks A, B and C. Incidentally, in the ranks A and B, no influence on an image quality was also confirmed.

A: A vertical stripe in a sheet (paper) discharging direction was not observed on the developing roller and on the image.

B: On opposite sides of the developing roller, a slight thin stripe in a circumferential direction was observed, and a slight vertical stripe in the sheet discharging direction was observed on the image, but these stripes were not conspicuous such that the stripes had the influence on the image quality.

C: A plurality of stripes having the influence on the image quality were observed on the developing roller and on the image.

Evaluation of Falling

The image forming apparatus after the durability test was conducted and ended was disassembled, and whether or not "falling" (separated state) of the toner occurred was checked, and evaluation was performed by "o (passed)" and "x (failed)".

The "falling" phenomenon in this evaluation is a state in which on a side downstream of a toner regulating portion of the developing roller, the toner is not held on the developing roller but falls in the direction of gravitation. When the image formation is continued in a state in which the "falling" of the toner occurred, the toner falling is liable to lead contamination of the inside of the image forming apparatus and the recording material (paper) with the toner, so that a lowering in image quality is liable to occur in some cases.

Experimental Result 1

In the following, evaluation results of the "development stripe" and the "falling" in this embodiment are shown in a table 4.

TABLE 4

| Toner | Blade | DS*[1] | Falling | TE*[2] |
|---|---|---|---|---|
| a | a | A | o | o |
| a | b | A | o | o |
| a | c | A | o | o |
| a | d | A | x | x |
| b | a | A | o | o |
| b | b | A | o | o |
| b | c | A | o | o |
| b | d | A | x | x |
| c | a | A | o | o |
| c | b | A | o | o |
| c | c | A | o | o |
| c | d | A | x | x |
| d | a | C | o | x |
| d | b | C | o | x |
| d | c | C | o | x |
| d | d | C | x | x |
| e | a | C | o | x |
| e | b | C | o | x |
| e | c | C | o | x |
| e | d | B | x | x |

*[1]"DS" represents the development stripe.
*[2]"TE" represents a total evaluation.

In the constitution of this embodiment, a bent blade can be used by using the toner having the Martens hardness of 200 MPa or more and 1100 MPa or less as measured under the condition of the maximum load of $2.0\times10^{-4}$ N. That is, even in the case where the bent blade is used, toner hardness is high, and therefore, even when the toner is repetitively rubbed at an outwardly projected portion of the bent blade, the toner does not fuse on the bent blade.

Further, by using the developing blade having the radius of curvature R [mm] satisfying $R\leq0.3$ at the contact portion between the developing blade and the developing roller, a peak pressure was capable of being ensured, so that it was possible to suppress the falling of the toner while regulating the toner. Incidentally, in the case of $R<0.08$, the radius of curvature of the curved surface portion of the developing blade is excessively small, and therefore, the developing blade is liable to be broken during processing and thus it is difficult to prepare the developing blade.

As can be understood from the table 4, in the case where the toners a to c and the blades a to c were used in combination, the peak pressure to the developing roller was capable of being ensured while suppressing the "development stripe" due to the toner fusion, and the "falling" was capable of being suppressed.

In the case of using the toner d, the Martens hardness was 1200 MPa which was excessively hard, so that the toner d was liable to damage the surfaces of the developing blade and the developing roller, and the toner layer on the developing roller was not properly formed, so that the "development stripe" occurred.

In the case of using the toner e, the Martens hardness was 185 MPa which was soft, and therefore, the toner was deposited on the outwardly projected portion of the curved surface portion of the blade, and was repetitively rubbed by the blade, so that fusion of the toner occurred. At the portion where the toner was fused, the toner layer was not formed on the developing roller surface, and therefore, the "development stripe" occurred similarly.

Further, in the case of using the blade d, the radius of curvature R is large, and therefore, an area of the contact portion with the developing roller expands and the pressure is distributed, so that the peak pressure to the direction is not readily ensured. Accordingly, the toner on the developing roller was not capable of being regulated, so that the falling occurred.

As described above, from various experimental results and by the study by the present inventors, a constitution capable of alleviating a degree of fusion of the developer (toner) on the regulating blade while ensuring the contact pressure (peak pressure) of the regulating member to the developer carrying member was attained.

That is, the toner having the Martens hardness of 200 MPa or more and 1100 MPa or less as measured under the condition of the maximum load of $2.0\times10^{-4}$ N is used, and the radius of curvature R [mm] at the contact portion between the developing blade and the developing roller is $0.08\leq R\leq0.3$. Accordingly to such a constitution, it is possible to avoid the toner fusion while suppressing the toner falling by ensuring the peak pressure to the developing roller.

OTHER EMBODIMENTS

In the above-described embodiment, by a processing method which is a "bending (process)" in which the free end portion of the developing blade is bent, a predetermined radius of curvature can be provided to the contact portion. Incidentally, in order to provide the contact portion with the predetermined radius of curvature, a processing method other than the "bending" may also be used. For example, it is possible to cite "polishing" such that the free end portion of the developing blade is polished little by little. Incidentally, the "bending" is advantageous in terms of cost compared with the "polishing" and therefore is a desirable process.

The constitution of this embodiment can be summarized as follows.

That is, the developing device (4) of this embodiment includes the developer carrying member (17) for carrying the developer, the developing frame (18) for rotatably supporting the developer carrying member (17), and the regulating member (21). The regulating member (21) is mounted on the developing frame (18) and regulates the thickness of the developer (T) (40) carried on the developer carrying member (17) in contact with the developer carrying member (17). Further, the regulating member (21) includes the curved surface portion (2102) capable of contacting the surface of the developer carrying member (17) along a line (2101).

When the Martens hardness, of the toner contained in the developer, measured under the condition of the maximum load of $2.0\times10^{-4}$ N is HM, and the radius of curvature of the curved surface portion is Rb, the following relationships are satisfied:

$200\ \text{MPa}\leq HM\leq1100$ Pa, and $0.08\ \text{mm}\leq Rb\leq0.3$ mm.

Further, the process cartridge (7) of this embodiment is capable of including the developing device (4) and the image bearing member (1) bearing the developer image.

Further, the image forming apparatus (100) of this embodiment is capable of including the developing device (4), the image bearing member (1) bearing the developer image, and the transfer member (9) for transferring the developer image from the image bearing member (1) onto the recording material.

In this embodiment, the regulating member (21) is capable of including the first portion (2103) and the second portion (2104). Specifically, when the regulating member (21) is seen in the direction of the rotational axis (1701) of the developer carrying member (17), one end (2103A) of the first portion (2103) is fixed to the developing frame (18) and the first portion (2103) extends in the first direction (D11)

from the developing frame side toward the developer carrying member side. One end (2104A) of the second portion (2104) is connected to the other end (2103B) of the first portion (2103) and extends in the second direction (D12) crossing the first direction (D11). The curved surface portion (2102) may desirably be formed at the portion where the first portion (2103) and the second portion (2104) are connected to each other.

In this embodiment, the second portion (2104) may also be formed by bending the other end of the first portion (2103), and the curved surface portion (2102) may desirably be formed at the bent portion.

In this embodiment, when the regulating member (21) is seen in the rotational axis direction of the developer carrying member (17), the distance from the position (P1), where the bending at the first portion (2103) is started, to the other end (2104B) of the second portion (2104) with respect to the direction perpendicular to the first direction (D11) can be defined as H. At this time, 0.15 mm≤H ≤0.5 mm may preferably be satisfied.

In this embodiment, when the regulating member (21) is seen in the rotational axis direction of the developer carrying member (17), 80°≤θ≤130° where θ is the angle between the first direction (D11) and the second direction (D12) may preferably be satisfied.

In this embodiment, when the ten-point average roughness of the curved surface portion (2102) of the regulating member (21) is Rz, 0 μm≤Rz≤11 μm may preferably be satisfied.

In this embodiment, the developer carrying member (17) is capable of including the elastic layer (1702). The MD-1 hardness of the elastic layer (1702) may preferably be 20° or more and 60° or less, and the center-line average roughness Ra of the surface roughness of the elastic layer (1702) may preferably be 0.2 or more and 2 or less.

In this embodiment, the regulating member (21) may preferably be formed with the metallic member.

In this embodiment, the developer may also be the non-magnetic one-component developer.

In this embodiment, the radius of curvature Rb of the curved surface portion (2102) and the radius of curvature Rd of the surface of the developer carrying member (17) may preferably satisfy Rd>Rb.

In this embodiment, the toner particles of the toner is capable of including the surface layer containing the organosilicon polymer.

In this embodiment, the organosilicon polymer is capable of having the structure represented by R—$SiO_{3/2}$ (formula (1)) where R is the hydrocarbon group having 1-6 carbon atoms.

In this embodiment, the developing device is mountable in and dismountable from the apparatus main assembly of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2018-213994 filed on Nov. 14, 2018 and 2019-155097 filed on Aug. 27, 2019, which are hereby incorporated by reference herein in their entirety.

What is claimed is:

1. A developing device including a developer, the developing device comprising:

a developer carrying member configured to carry the developer;

a developing frame configured to rotatably support said developer carrying member; and a regulating member provided in said developing frame and configured to regulate a thickness of the developer carried on said developer carrying member by contact thereof with a surface of said developer carrying member, wherein said regulating member includes a curved surface portion contactable to the surface of said developer carrying member, and wherein the following relationships are satisfied:

200 MPa≤HM≤1100 MPa, and 0.08 mm≤Rb 0.3 mm, where HM is a Martens hardness of toner contained in the developer under a maximum load of $2.0\times10^{-4}$ N, and Rb is a radius of curvature of said curved surface portion.

2. A developing device according to claim 1, wherein when said regulating member is seen in a rotational axis direction of said developer carrying member, said regulating member includes, a first portion which includes one end fixed to said developing frame and which extends in a first direction from a developing frame side toward a developer carrying member side, and a second portion which includes one end connected to the other end of said first portion and which extends in a second direction crossing the first direction, and wherein said curved surface portion is formed at a portion where said first portion and said second portion are connected to each other.

3. A developing device according to claim 2, wherein said second portion is formed by bending the other end of said first portion, and wherein said curved surface portion is formed at a portion where the other end of said first portion is bent.

4. A developing device according to claim 3, wherein when said regulating member is seen in the rotational axis direction, the following relationship is satisfied:

0.15 mm≤H≤0.5 mm, where H is a distance from a position where bending of said first portion is started to the other end of said second portion.

5. A developing device according to claim 2, wherein when said regulating member is seen in the rotational axis direction, the following relationship is satisfied:

80°≤θ≤130°, where θ is an angle between the first direction and the second direction.

6. A developing device according to claim 1, wherein said regulating member satisfies the following relationship:

0 μm≤Rz≤11 μm, where Rz is a ten point average roughness of said curved surface portion.

7. A developing device according to claim 6, wherein said developer carrying member includes an elastic layer at a surface thereof, and wherein an MD 1 hardness of said elastic layer is 20° or more and 70° or less, and a center line average roughness Ra of a surface roughness of the elastic layer is 0.2 μm or more and 2 μm or less.

8. A developing device according to claim 1, wherein said regulating member is a metal member.

9. A developing device according to claim 1, wherein the developer is a non magnetic developer.

10. A developing device according to claim 1, wherein the following relationship is satisfied:

Rd>Rb, where Rd is a radius of curvature of a surface of said developer carrying member.

11. A developing device according to claim 1, wherein the toner comprises toner particles each having a surface layer containing a organosilicon polymer.

12. A developing device according to claim 11, wherein said organosilicon polymer has a structure represented by the following formula (1):

$$R\ SiO_{3/2} \quad (1),$$

where R is a hydrocarbon group having carbon atoms of 1 or more and 6 or less.

13. A developing device according to claim 1, wherein said developing device is mountable in and dismountable from a main assembly of an image forming apparatus for forming an image.

14. A process cartridge comprising:

a developing device according to claim 1; and an image bearing member configured to bear a developer image.

15. An image forming apparatus comprising:

a developing device according to claim 1;

an image bearing member configured to bear a developer image; and a transfer member configured to transfer the developer image from said image bearing member onto a recording material.

* * * * *